US011745188B2

(12) United States Patent
Hughes

(10) Patent No.: US 11,745,188 B2
(45) Date of Patent: Sep. 5, 2023

(54) HORIZONTALLY FED DISK GRINDING SYSTEM AND METHOD

(71) Applicant: COMCORP, Inc., Montesano, WA (US)

(72) Inventor: John H. Hughes, Montesano, WA (US)

(73) Assignee: COMCORP, INC., Montesano, WA (US)

( * ) Notice: Subject to any disclaimer, the term of this patent is extended or adjusted under 35 U.S.C. 154(b) by 108 days.

(21) Appl. No.: 17/373,640

(22) Filed: Jul. 12, 2021

(65) Prior Publication Data

US 2023/0008083 A1 Jan. 12, 2023

(51) Int. Cl.

| | |
|---|---|
| ***B02C 7/14*** | (2006.01) |
| ***B02C 1/00*** | (2006.01) |
| ***B02C 7/16*** | (2006.01) |
| ***B02C 13/10*** | (2006.01) |
| ***B02C 13/28*** | (2006.01) |
| ***B02C 13/282*** | (2006.01) |
| ***B02C 23/02*** | (2006.01) |
| ***B02C 18/22*** | (2006.01) |
| ***B02C 18/16*** | (2006.01) |
| ***B02C 7/12*** | (2006.01) |
| ***B02C 21/02*** | (2006.01) |

(52) U.S. Cl.

CPC ..... *B02C 7/14* (2013.01); *B02C 1/00* (2013.01); *B02C 7/16* (2013.01); *B02C 13/10* (2013.01); *B02C 13/28* (2013.01); *B02C 13/282* (2013.01); *B02C 23/02* (2013.01)

(58) Field of Classification Search

CPC .. B02C 7/14; B02C 1/00; B02C 13/10; B02C 13/28; B02C 13/282; B02C 23/02; B27L 1/00; B27L 1/025; B27L 1/045; B27L 1/05; B27L 1/06; B27L 11/00; B27L 11/002; B27L 11/02; B27L 11/04; B27L 11/0608

See application file for complete search history.

(56) References Cited

U.S. PATENT DOCUMENTS 4,222,531 A * 9/1980 Thumm ..... B27L 11/002 241/281
4,412,659 A * 11/1983 Crawford ..... B02C 13/286 241/35
4,934,615 A * 6/1990 Osborne ..... A01F 29/005 241/186.4

(Continued)

*Primary Examiner* — Matthew Katcoff
*Assistant Examiner* — Mohammed S. Alawadi
(74) *Attorney, Agent, or Firm* — SEED IP LAW GROUP LLP

(57) ABSTRACT

A horizontally fed disk grinding system includes a tray coupled to a trailer for receiving bulk material. The system further includes a grind hub coupled to the trailer and a cutter disk coupled to the grind hub. The grind hub is structured to rotate about a grind hub axis and the cutter disk is structured to rotate about a cutter disk axis and about the grind hub axis. A grind ring is coupled to the trailer and is structured to slide to engage the grind hub during use. A plurality of plates are coupled to the tray and structured to oscillate to feed material from the tray to the grind hub and the cutter disk, where the material is reduced to particulate form. The grind hub further includes an outlet and a conveyor rotatably coupled to the trailer to convey the particulate material away from the outlet to a selected location.

46 Claims, 16 Drawing Sheets

(56) References Cited

U.S. PATENT DOCUMENTS

| | | | | |
|---|---|---|---|---|
| 5,060,873 | A * | 10/1991 | Strong | B27L 11/002 144/176 |
| 7,210,642 | B2 * | 5/2007 | Cook | B02C 18/067 241/74 |
| 10,357,776 | B2 | 7/2019 | Hughes | |
| 2004/0118956 | A1 * | 6/2004 | Hughes | B02C 18/067 241/101.76 |
| 2006/0230893 | A1 * | 10/2006 | Brooks | B27L 11/02 83/13 |
| 2011/0174907 | A1 * | 7/2011 | Davis | B02C 23/02 241/222 |
| 2013/0037171 | A1 * | 2/2013 | O'Halloran | B27B 31/006 144/242.1 |
| 2019/0329263 | A1 | 10/2019 | Hughes | |

* cited by examiner

HORIZONTALLY FED DISK GRINDING SYSTEM AND METHOD

TECHNICAL FIELD

The present disclosure generally relates to a horizontally fed disk grinding system and method for grinding bulk material into a particulate form.

DESCRIPTION OF THE RELATED ART

It is generally desirable in many industries to reduce large pieces of solid material to a particulate form. For instance, in managing wood and tree waste, it is desirable to grind stumps, branches, and wood scraps into smaller wood chips. Wood chips are more easily and efficiently transported, stored, and used for a variety of purposes. In other instances, it is desirable to reduce large pieces of waste material, such as plastic, for recycling or disposal. In still other instances, it is desirable to reduce pieces of rock, metal, asphalt, or other extremely hard material, for disposal.

Refiners of various size and operation are generally available for performing this function. One style of refiner includes a refining chamber defined by a sidewall and a bottom floor at one end of the sidewall. An annular ring in the same plane and surrounding the bottom floor is attached to the sidewall and rotates with the sidewall. For instance, a refiner of this style may include a comminuting chamber in which a rotatably-mounted cutter disk with attached blades impacts solid material introduced into the chamber and reduces the material to particulate form.

Some such refiners operate by rotating both the chamber sidewall and the bladed cutter disk, sometimes in the same direction, and sometimes in opposite directions. The rotation of the sidewall imparts rotational motion to the solid material placed in the chamber. As the material in the chamber rotates with the chamber sidewall, the material comes into contact with the rotating cutter disk. The blades of the cutter disk impact the material, thereby cutting, ripping and tearing the material into successively smaller pieces. The annular portion of the bottom of the chamber that rotates with the sidewall typically includes a screened exit through which the material, once refined to a particular size, may pass out of the chamber.

In other traditional larger grinder embodiments, a vertically fed configuration has been employed with a grinding wheel at the bottom of a large container with substantially vertical sidewalls. Such vertical grinding systems have employed "hammers" on the grinding wheel that smash and pound bulk material over and over again until it is broken down into smaller particulate material. The vertical configuration of these embodiments is useful to leverage gravity to push the bulk material towards the grinding wheel. However, these systems have several significant drawbacks. For example, since these system "hammer" the bulk material instead of "cutting" the bulk materials, much more force, and thus much more power is required to operate these systems (e.g., two to four times the amount of energy). Additionally, since such large amounts of force are being used to operate these large vertical grinding systems, the "hammers" on the grinding wheels will occasionally fail, break off the wheel, and go flying through the air. Such projectile broken hammer components can seriously injury or even kill people standing nearby or even a significant ways away from the grinder.

The small number of legacy horizontally fed grinding systems have been relatively unsuccessful since they suffered from difficulties associated with a lack of gravity to advance the grinding material towards the cutter mechanism. Such legacy horizontal grinding systems have also had problems due to a lack of uniform grinding mechanisms. Furthermore, such legacy horizontal grinding systems have often relied on the sharpness of cutter systems, which can often dull quickly when cutting all manner of materials from wood, to plastic, to metal. Some conventional horizontally fed grinding systems also feed material to a single stationary wheel, which limits the size of the feed opening and prevents processing of larger bulk materials.

Notably, all of the subject matter discussed in this section is not necessarily prior art and should not be assumed to be prior art merely as a result of its discussion in this section. Accordingly, any recognition of problems in the prior art discussed in this section or associated with such subject matter should not be treated as prior art unless expressly stated to be prior art. Instead, the discussion of any subject matter in this section should be treated as part of the identification of the technological problem to be overcome, which in and of itself may also be inventive.

BRIEF SUMMARY

One or more embodiments of a portable grinding machine or system may be summarized as including: a trailer; a tray coupled to the trailer; a grind hub coupled to the trailer and structured to rotate about a grind hub axis; a grind ring coupled to the tray and structured to engage the grind hub during operation, the grind ring having an adjustable outlet; a cutter disk coupled to the grind hub and structured to rotate about a cutter disk axis, the cutter disk axis being offset from the grind hub axis; a plurality of plates coupled to the tray and structured to slide along the tray back and forth towards the cutter disk and away from the cutter disk, wherein the plurality of plates includes a first row of plates and a second row of plates, the first row of plates and the second row of plates structured to oscillate relative to each other, where the first row of plates moves towards the cutter disk while the second row of plates moves away from the cutter disk, and where the first row of plates moves away from the cutter disk while the second row of plates moves towards the cutter disk; and a conveyor coupled to the grind hub having a first end and a second end, the first end of the conveyor positioned proximate the adjustable outlet of the grind ring, the conveyor including a belt that transports ground particulate matter away from the cutter disk and grind hub.

The portable grinding machine may further include: the first row of plates pushing bulk materials towards the cutter disk while the second row of plates moves away from the cutter disk, and wherein the second row of plates pushes bulk materials towards the cutter disk while the first row of plates moves away from the cutter disk; the conveyor being rotatable relative to the trailer about the first end of the conveyer in a horizontal direction to move the second end of the conveyer towards a front end of the trailer or towards a rear end of the trailer, and wherein the conveyor is rotatable relative to the trailer about the first end of the conveyer in a vertical direction to change a position of the conveyer from parallel to a ground surface to perpendicular to the ground surface; the tray being a channel including a base and a first sidewall and a second sidewall extending from the base, the plurality of plates coupled to the base of the tray, the portable grinding machine further comprising a plurality of side feeders coupled to the first sidewall and the second sidewall of the tray; and at least one of the plurality of plates and at least one of the plurality of side feeders including a plurality of teeth structured to ratchet a material received in the tray toward the grind hub and the cutter disk.

The portable grinding machine may further include: the grind hub structured to rotate in a first plane and the cutter disk structured to rotate in a second plane that is at an offset angle from the first plane; the first plane being substantially vertical and the second plane being at an offset angle to the first plane between 1 and 10 degrees; a limit plate coupled to the grind hub and positioned between the grind hub and the grind ring; and the grind ring further including a plurality of teeth arranged around an interior circumference of the grind ring proximate the grind hub.

One or more embodiments of a grinding machine may be summarized as including: a grind hub structured to rotate about a grind hub axis; a cutter disk coupled to the grind hub and structured to rotate about a cutter disk axis, the cutter disk axis being offset from the grind hub axis, wherein the cutter disk is structured to rotate about the cutter disk axis while also being structured to rotate about the grind hub axis; a tray including a first row of plates coupled to the tray and a second row of plates coupled to the tray, the first row of plates and the second row of plates structured to oscillate relative to each other and towards the cutter disk and away from the cutter disk to advance bulk material towards the cutter disk; and a grind ring coupled to the tray, wherein the grind ring is structured to engage with the grind hub, the cutter disk, and the grind plate.

The grinding machine may further include: a frame coupled to the tray and a plurality of wheels coupled to the frame; the grind hub having a first side and a second opposite the first side, the grind hub further including a sheave and pulley assembly coupled to the first side of the grind hub, a grind plate coupled to the second side of the grind hub, a first limiter coupled to the grind plate, a plurality of baffles coupled to the grind plate, a second limiter coupled to the plurality of baffles; the sheave and pulley assembly including an axle located proximate a center of the grind hub and a wheel coupled to the grind hub and spaced from the center of the grind hub, the sheave and pulley assembly further including a belt mechanically coupled to the axle and the wheel; the cutter disk being mechanically coupled to the wheel of the gear and pulley assembly with the cutter disk structured to rotate around the center of the grind hub; the grind ring further including a plurality of teeth arranged around an interior circumference of the grind ring proximate the grind hub; the first row of plates pushing the bulk materials towards the cutter disk while the second row of plates moves away from the cutter disk, and wherein the second row of plates pushes bulk materials towards the cutter disk while the first row of plates moves away from the cutter disk; and a conveyor rotatably coupled to the grind hub, the conveyor including a belt that transports ground particulate matter away from the cutter disk and grind hub.

The grinding machine may further include: the conveyor being rotatable relative to the grind hub about a first end of the conveyer in a horizontal direction to move a second end of the conveyer towards a front end of the grind hub or towards a rear end of the grind hub, and wherein the conveyor is rotatable relative to the grind hub about the first end of the conveyer in a vertical direction to change a position of the conveyer relative to a ground surface in the vertical direction; the tray being a channel including a base and a first sidewall and a second sidewall extending from the base, the first row of plates coupled to the base of the tray and the second row of plates coupled to the base of the tray, the grinding machine further comprising a plurality of side feeders coupled to the first sidewall and the second sidewall of the tray; at least one of the first row of plates and at least one of the plurality of side feeders include a plurality of teeth structured to ratchet the bulk material received in the tray toward the grind hub and the cutter disk; and the grind hub being structured to rotate about the grind hub axis in a first plane that is substantially vertical and cutter disk is structured to rotate about the cutter disk axis in a second plane at an offset angle to the first plane between 1 and 10 degrees.

One or more embodiments of a grinding machine may be summarized as including: a body having a grinding portion including a grind hub and a grind ring, the grind hub structured to rotate in a first plane about a grind hub axis, and an inlet portion including a tray coupled to the grind ring; an advancement system coupled to the tray structured to advance bulk material towards the grinding portion; a cutter disk coupled to the grinding portion of the body and structured to rotate about a cutter disk axis in a second plane at an offset angle to the first plane, wherein the cutter disk is structured to rotate about a cutter disk axis while also being structured to rotate about the grind hub axis; and a conveyor coupled to the body, the conveyor including a belt that transports ground particulate matter away from the cutter disk and grind hub.

The grinding machine may further include: a trailer including a frame coupled to the body and a plurality of wheels coupled to the frame; the grind ring being structured to slide to engage the grind hub, the grind ring having an outlet and the grind ring having a plate structured to selectively cover the outlet of the grind ring to vary a size of a particulate material output from the grind ring through the outlet; the grind hub including a grind plate with a center and an outer peripheral edge, the grinding machine further comprising a first limiter coupled to the grind plate and positioned proximate the center of the grind plate and a second limiter coupled to the grind plate and positioned proximate the outer peripheral edge of the grind plate; the grind hub including an outer peripheral edge and a plurality of baffles positioned proximate the outer peripheral edge; the offset angle between the first plane and the second plane being between 1 and 10 degrees; and the advancement system being one of a plurality of plates, a belt conveyor, a chain conveyor, a ram plate, one or more augers, and one or more vibrators.

The grinding machine may further include: the advancement system being a plurality of plates coupled to the tray including a first row of plates structured to push the bulk materials towards the cutter disk while a second row of plates moves away from the cutter disk and a second row of plates structured to push bulk materials towards the cutter disk while the first row of plates moves away from the cutter disk; the conveyor being rotatable relative to the body about a first end of the conveyer in a horizontal direction to move a second end of the conveyer towards a front end of the body or towards a rear end of the body, and wherein the conveyor is rotatable relative to the body about the first end of the conveyer in a vertical direction to change a position of the conveyer from parallel to a ground surface to perpendicular to the ground surface; the tray being a channel including a base and a first sidewall and a second sidewall extending from the base, and the advancement system including a plurality of plates coupled to the base of the tray, the portable grinding machine further comprising a plurality of side feeders coupled to the first sidewall and the second sidewall of the tray; at least one of the plurality of plates and at least one of the plurality of side feeders including a plurality of teeth structured to ratchet a material received in the tray toward the grind hub and the cutter disk; and a limit plate coupled to the grind plate and positioned between the grind plate and the grind ring.

One or more embodiments of a grinding machine may be summarized as including: a body having a grinding portion and an inlet portion, the grinding portion including a grind hub, grind plate, and a grind ring with the grind hub structured to rotate in a first plane, and the inlet portion including a tray coupled to the grind ring; a cutter disk coupled to the grinding portion of the body and structured to rotate in a second plane at an offset angle to the first plane; and an advancement system coupled to the body structured to advance bulk material towards the grinding portion.

The grinding machine may further include: the advancement system being one of a plurality of plates, a belt conveyor, a chain conveyor, a ram plate, one or more augers, and one or more vibrators; the advancement system being a plurality of plates coupled to the tray including a first row of plates structured to push the bulk materials towards the cutter disk while a second row of plates moves away from the cutter disk and a second row of plates structured to push bulk materials towards the cutter disk while the first row of plates moves away from the cutter disk; a trailer coupled to the body and a conveyor coupled to the body, the conveyor including a belt that transports ground particulate matter away from the cutter disk and grind hub; and the conveyor being rotatable relative to the trailer about a first end of the conveyer in a horizontal direction to move a second end of the conveyer towards a front end of the trailer or towards a rear end of the trailer, and wherein the conveyor is rotatable relative to the trailer about the first end of the conveyer in a vertical direction to change a position of the conveyer from parallel to a ground surface to perpendicular to the ground surface.

The grinding machine may further include: the tray being a channel including a base and a first sidewall and a second sidewall extending from the base, and the advancement system includes a plurality of plates coupled to the base of the tray, the portable grinding machine further comprising a plurality of side feeders coupled to the first sidewall and the second sidewall of the tray; at least one of the plurality of plates and at least one of the plurality of side feeders including a plurality of teeth structured to ratchet a material received in the tray toward the grind hub and the cutter disk; and the offset angle being between 1 and 10 degrees; a limit plate coupled to the grind hub and positioned between the grind hub and the grind ring.

The grinding machine may further include: the grind hub including a drive hub with an outer surface, the grinding machine further comprising a drive assembly coupled to the body and including a motor and a belt on the outer surface of the drive hub, the motor structured to rotate the belt to rotate the drive hub; the cutter disk being a first cutter disk, the grinding machine further including a second cutter disk coupled to the grinding portion of the body and structured to rotate; and the second cutter disk being structured to rotate in a third plane at an offset angle to at least one of the first plane and the second plane.

BRIEF DESCRIPTION OF THE SEVERAL VIEWS OF THE DRAWINGS

The present disclosure will be more fully understood by reference to the following figures, which are for illustrative purposes only. These non-limiting and non-exhaustive embodiments are described with reference to the following drawings, wherein like labels refer to like parts throughout the various views unless otherwise specified. The sizes and relative positions of elements in the drawings are not necessarily drawn to scale in some figures. For example, the shapes of various elements are selected, enlarged, and positioned to improve drawing legibility. In other figures, the sizes and relative positions of elements in the drawings are exactly to scale. The particular shapes of the elements as drawn may have been selected for ease of recognition in the drawings. The figures do not describe every aspect of the teachings disclosed herein and do not limit the scope of the claims.

DETAILED DESCRIPTION

Persons of ordinary skill in the art will understand that the present disclosure is illustrative only and not in any way limiting. Other embodiments of the presently disclosed system and method readily suggest themselves to such skilled persons having the assistance of this disclosure.

Each of the features and teachings disclosed herein can be utilized separately or in conjunction with other features and teachings to provide horizontal disk grinding system and method. Representative examples utilizing many of these additional features and teachings, both separately and in combination, are described in further detail with reference to attached FIGS. 1-9B. This detailed description is merely intended to teach a person of skill in the art further details for practicing aspects of the present teachings and is not intended to limit the scope of the claims. Therefore, combinations of features disclosed in the detailed description may not be necessary to practice the teachings in the broadest sense, and are instead taught merely to describe particularly representative examples of the present teachings.

In the description below, for purposes of explanation only, specific nomenclature is set forth to provide a thorough understanding of the present system and method. However, it will be apparent to one skilled in the art that these specific details are not required to practice the teachings of the present system and method.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples in some embodiments. In some embodiments, the dimensions and the shapes of the components shown in the figures are intended to limit the dimensions and the shapes of the components.

Figure 1:
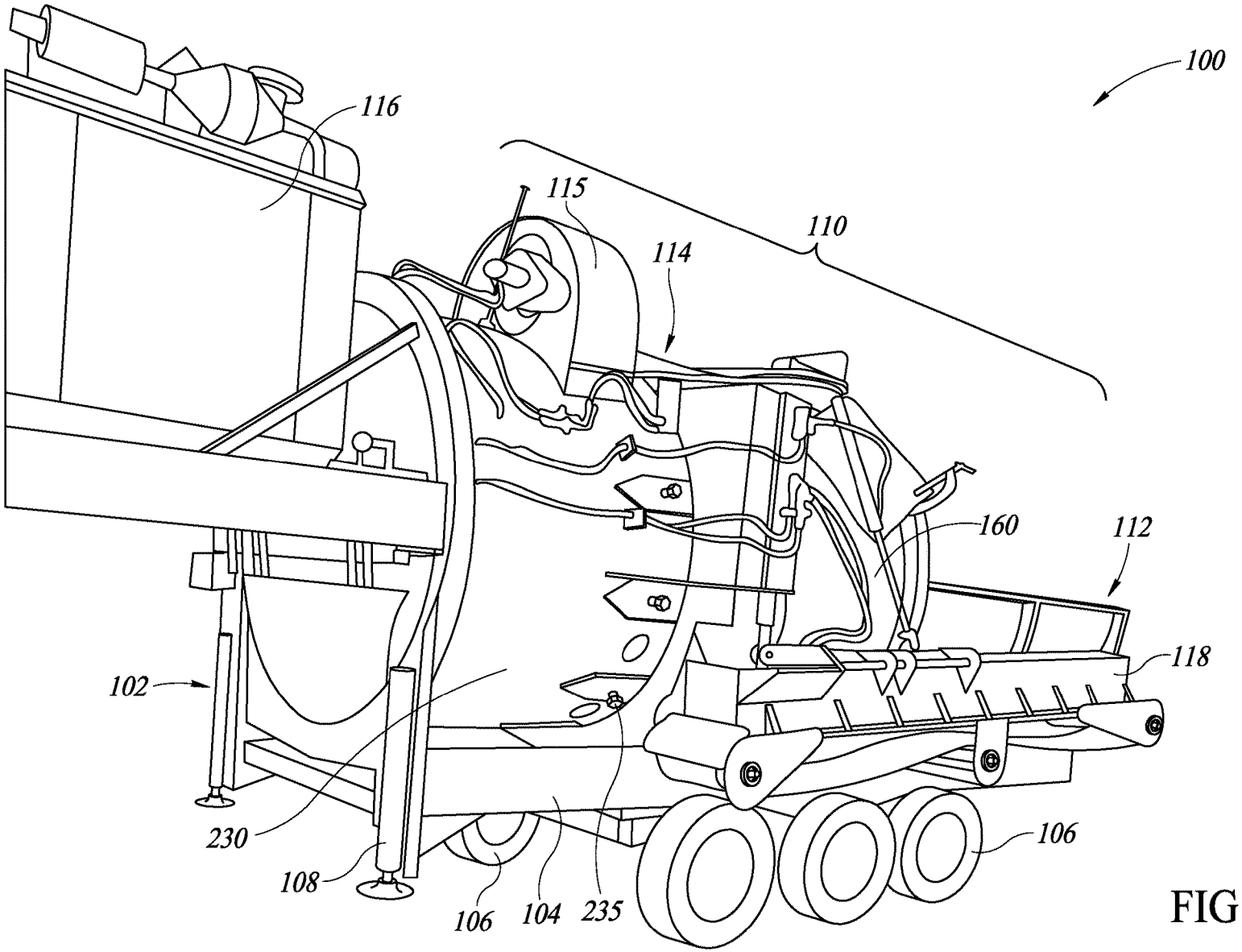
FIG. 1 is a perspective view of an embodiment of a horizontally fed disk grinding system.

Beginning with FIG. 1, illustrated therein is a perspective view of an embodiment of a horizontal disk grinding system 100, which may also be referred to herein as a horizontally fed disk grinding system 100, a refiner 100, or a grinding system 100. The system 100 is "horizontal" in the sense that bulk material is loaded into the grinding system 100 and reduced to particulate form while the grinding material travels horizontally towards the grinding hub, with the grinding hub oriented in a substantially vertical plane. In other words, "horizontal" refers to a "horizontally fed" system as opposed to the vertically fed systems discussed herein. This arrangement reduces the impact to the grinding components of the grinding system 100 and provides increased safety relative to known vertical grinders or vertically fed grinders where material is fed into the grind and ground into particulate form in a vertical direction with cutting occurring in a horizontal plane. Such vertical grinders are known to throw or project material at high speeds that can seriously injury or kill people standing nearby.

The orientation of the horizontal disk grinding system 100 enables the "mouth" or infeed opening of the system 100 to be large, (e.g., three feet or greater in some embodiments, four to five feet or greater in more preferred embodiments, six feet or greater in most preferred embodiments), while still being mountable to a street legal trailer so that the horizontal disk grinding system 100 is mobile enough to be easily moved to a job site, such as a site that has large lumber debris to be refined, removed, or both. One reason that vertical grinding systems have been popular is that gravity assists with feeding the grinding material towards the grinding implement. In a horizontal disk grinding system, such as system 100, other methods of advancing the grinding material are utilized because of the lack of gravitational force on the material in the horizontal direction. Past horizontal grinding systems have been attempted that used belts or chains to horizontally advance the bulk material. However, such attempts have been unsuccessful because the belts and chains often break or snag on the bulk material. Additionally, such belts and chains are undesirable because they deposit debris on the ground during the belt or chain cycling process. Such conventional horizontal grinding systems also have smaller infeed openings due to limited cutting performance. The recuperating process of the material input conveyer that oscillates back and forth as well as the cutter disk and grind hub, as described herein, overcomes these technological problems.

The system 100 includes a trailer 102 with a frame 104 and a plurality of wheels 106 coupled to the frame 104. Although not shown, the wheels 106 are rotatably mounted to the frame 104 with one or more axles, hubs, fasteners, and other like structures in a conventional manner. Further, the trailer 102 includes stabilizers 108 at a front end of the trailer 102 for stabilizing the system 100 against vibration and movement and for leveling the system 100 during use. The trailer 102 also includes a tongue and a coupler, such as a channel coupler, a ball coupler, or an A-frame coupler, among others, for removably coupling the trailer 102 to a towing vehicle, such as a truck.

As such, the system 100 is mobile and can be attached to a conventional trailer hitch of a tow vehicle, such as a truck, for transporting the system 100 between selected locations before, during, and after use. In one non-limiting example, the system 100 can be transported via the towing vehicle from a storage location to a job site, and once on the job site, the system 100 can be moved to selected locations around the site that are proximate the material to be ground into particulate form. Once the work is finished, the system 100 can be moved from the job site back to the storage location via trailer 102 until the process is repeated for a new project.

FIG. 1 further illustrates that the system 100 includes a body 110 with an inlet portion 112 and a grinding portion 114. The body 110 and all of its component parts are coupled, either directly or indirectly, to the trailer 102 and more specifically, to the frame 104 of the trailer 102. As will be explained in greater detail below, bulk material is input to the inlet portion 112 and reduced to particulate form by the grinding portion 114. A first housing 115 is coupled to the body 110 at the grinding portion 114 and includes a drive motor for a grind hub 158 of the grinding portion 114. As explained in further detail with reference to FIG. 9, the drive motor in the first housing 115 rotates a belt on an outside surface of a drive hub of the grind hub 158 to drive the drive hub. A second housing 116 is coupled to the trailer 102 and more specifically, to a platform on the trailer 102, and may include various drive components or systems for operation of the system 100. For example, the housing 116 may include a generator for providing power to various components of the system 100, a hydraulic motor for actuating various components of the system 100, or a rotary motor or generator for driving components of the system 100 described herein that rotate, among other structures. The system 100 also includes an output conveyor 118 that is structured to rotate relative to the body 110 in a horizontal direction and in a vertical direction to convey particulate material away from an outlet of the grinding portion 114 to a selected location, as described further with reference to FIG. 2A and FIG. 2B.

Figure 2A:
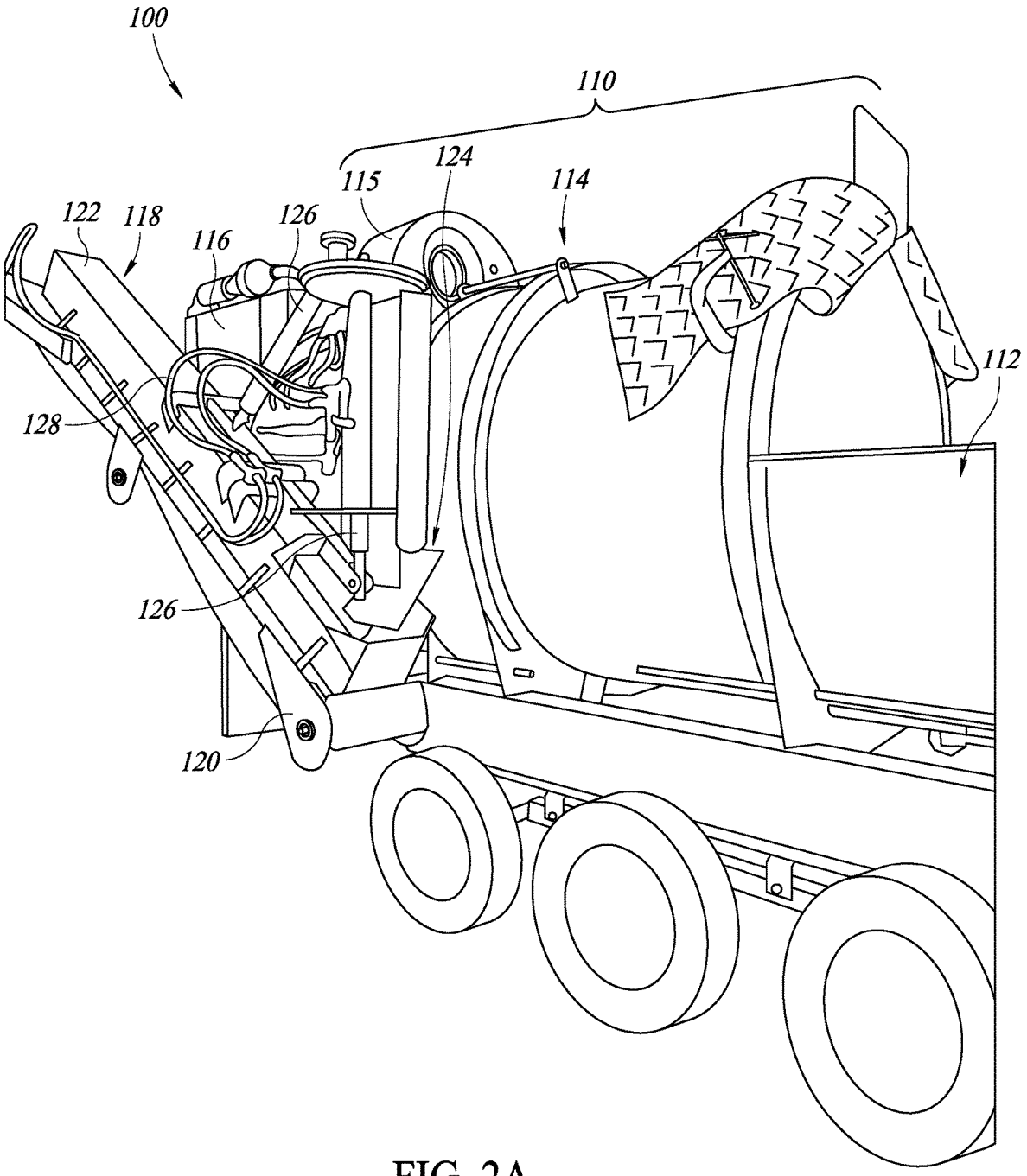
FIG. 2A is a perspective view of a conveyor of the system of FIG. 1 in a first position.
Figure 2B:
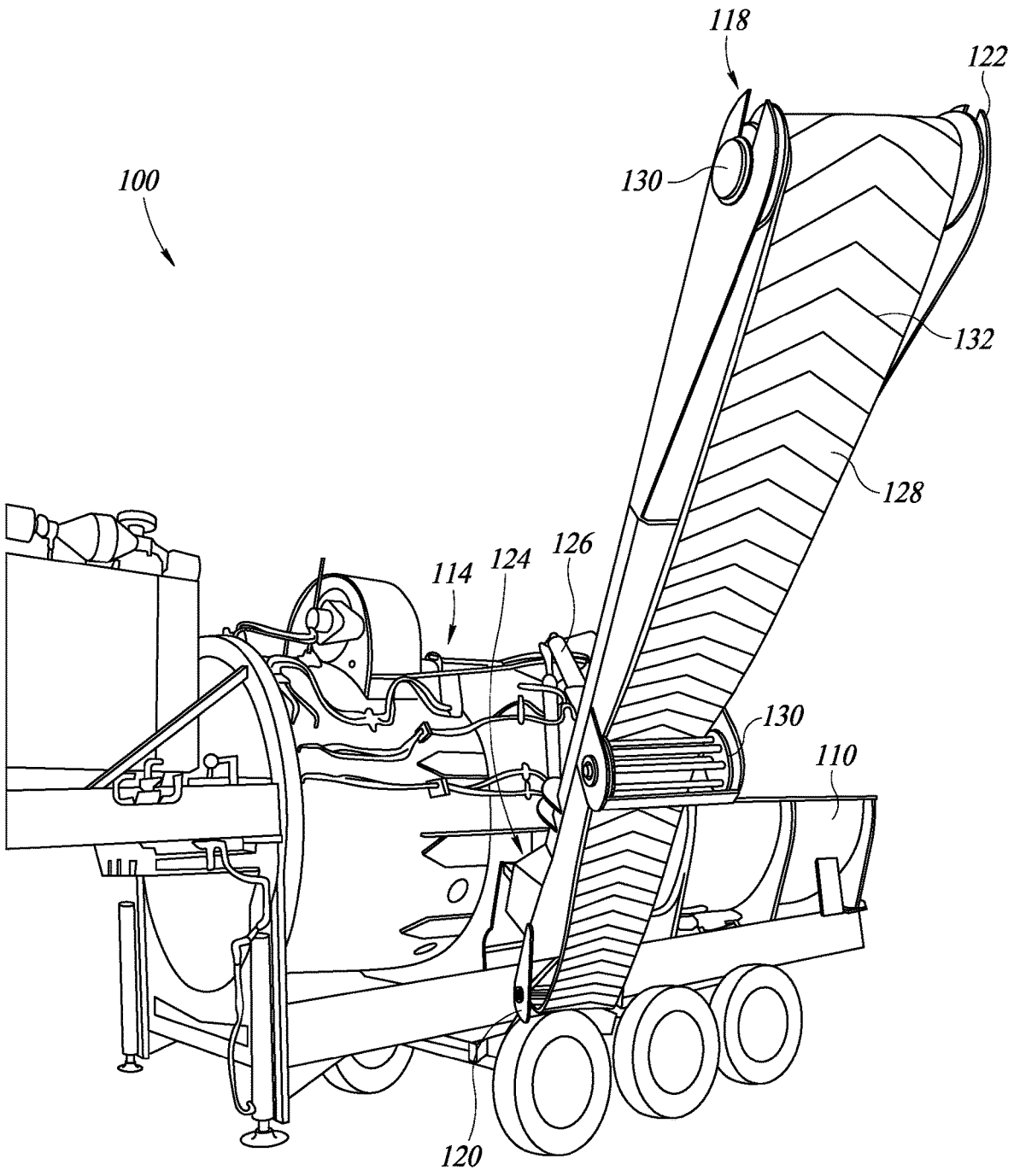
FIG. 2B is a perspective view of the conveyor of the system of FIG. 1 in a second position.

FIG. 2A is a perspective view of the output conveyor 118 in a first position and FIG. 2B is a perspective view of the output conveyor 118 in a second position. Beginning with FIG. 2A, the output conveyor 118 includes a first end 120 and a second end 122 and the grinding portion 114 of the body 110 of the system 100 includes an outlet 124 for discharging the particulate material. The first end 120 may be a proximal end that is positioned proximate the outlet 124 of the grinding portion 114 or proximate to the system 100 throughout a range of motion of the output conveyor 118 and the second end 122 may be a distal end of the output conveyor 118 that changes position relative to the body 110 as the output conveyor 118 moves. The system 100 may also include a number of actuators 126 that are mechanically or hydraulically coupled to the housing 116 for moving the output conveyor 118. For example, the actuators 126 may be hydraulic actuators that are driven by a hydraulic motor in the housing 116 that manipulates hydraulic fluid in lines 128 in response to user input on manipulatable controls. The actuators 126 may also be linear or rotary actuators driven by electricity transmitted through lines or wires 128, among other variations.

The first position of the output conveyor 118 illustrated in FIG. 2A may be a storage or transportation position where the output conveyor 118 is positioned aligned or parallel with the body 110. In some embodiments, the position of the conveyor 118 in FIG. 1 is the storage or transportation position of the conveyor 118 with the conveyor 118 parallel with and in close proximity to the body 110. In such embodiments, the first position shown in FIG. 2A illustrates a horizontal and vertical range of the conveyor 118 relative to the storage position in FIG. 1. In the storage position, the output conveyor 118 does not extend laterally from the body 110 in order to reduce the risk that the output conveyor 118 will hit an external structure during transportation or storage and to reduce an overall width of the system 100. FIG. 2A also illustrates that the body 110 includes at least one open side at the inlet portion 112 for receiving bulk material with the body 110 extending around the open inlet portion 112 at the grinding portion 114. Thus, the grinding portion 114 is enclosed to reduce the risk of injury or damage from debris during operation.

FIG. 2B illustrates the second position of the output conveyor 118, which may be a use or operation position. In FIG. 2B, the user manipulates the output conveyor 118 through controls that selectively activate the actuators 126 to rotate or move the output conveyor 118 in a horizontal or lateral direction (i.e., left to right in the orientation shown in FIG. 2B) and in a vertical or longitudinal direction (i.e., up and down in the orientation shown in FIG. 2B). Thus, in the second position, the second end 122 of the output conveyor 118 rotates to a selected position that is spaced from the body 110 while the first end 120 of the output conveyor 118 remains positioned proximate to the outlet 124 of the grinding portion 114 of the body 110. FIG. 1 also shows the conveyor in a third position that demonstrates that the output conveyor 118 has at least 180 degrees of rotational motion in the horizontal or lateral direction. Further, the conveyor 118 may have at least 90 degrees of motion in the vertical or longitudinal direction relative to a ground or support surface, or up to 120 degrees or more in some embodiments. In some embodiments, the conveyor 118 has a range of motion in the vertical direction from horizontal (i.e., 0 degrees) up to positive 45 degrees. As such, the position of the output conveyor 118 can be selected according to various factors for conveying the particulate material, such as whether the material will be stored in piles on the ground or whether the particulate material will be loaded into a truck. Further, the output conveyor 118 is adaptable for various types or sizes of trucks and other situations as well.

FIG. 2B also illustrates that the output conveyor 118 includes a belt 128 that rotates around a series of wheels, shafts, or pulleys 130. Specifically, the belt 128 may include cleats 132 or another like structure, which may also be referred to herein as teeth 132 or splines 132, on a surface of the belt 128 facing a central wheel 130 and facing away from wheels 130 at opposite ends 120, 122 of the conveyor 118. The motor in the housing 116 drives the wheels 130, which may also include corresponding teeth or splines, to engage and drive the belt 128. The belt 128 conveys particulate material output from the system 100 to the selected location via movement of the output conveyor 118 as described above.

Figure 3A:
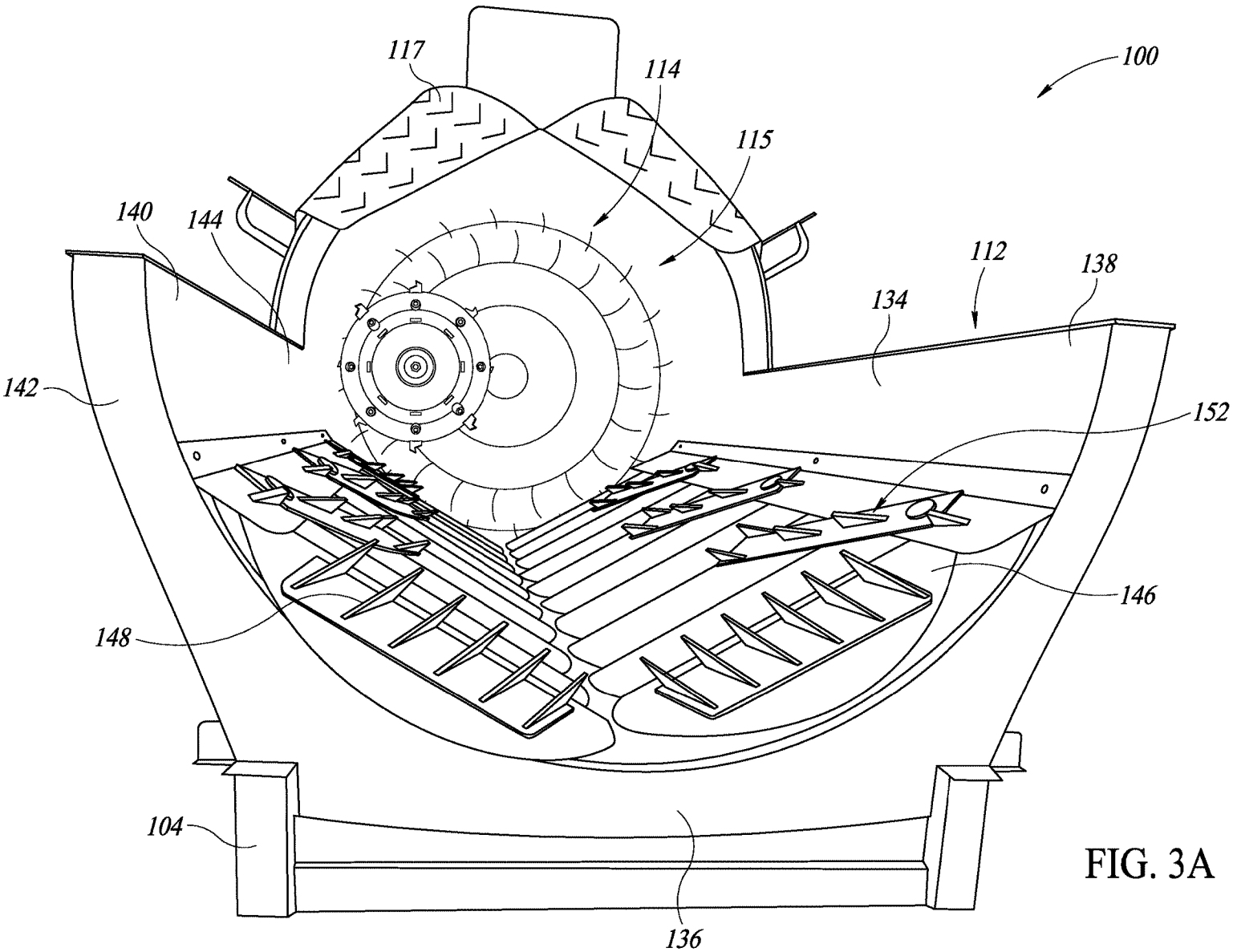
FIG. 3A is a rear elevational view of a tray for receiving material of the system of FIG. 1.

FIG. 3A illustrates the inlet portion 112 of the system 100 in more detail and in particular, illustrates a tray 134 of the inlet portion 112 of the system 100 for receiving material. As shown in FIG. 3A, the tray 134 has a shape similar to a hollow half cylinder cut lengthwise with a curved or semi-circular base and an open top. In other words, the tray 134 is a channel that is open to an external environment that includes a base 136 and a first sidewall 138 and a second sidewall 140 coupled to and extending from the base 136 to define the tray 134. In some embodiments, the tray 134 has a different shape or arrangement, such as square, trapezoidal, or other like shapes. The tray 134 is coupled to the frame 104 and includes a first end 142 and a second end 144. The first end 142 may be a rear end that is open to an external environment, as shown in FIG. 3A, or the first end 142 may be at least partially enclosed by a gate, plate, or other like structure for containing the material in some embodiments. The second end 144 is a forward end connected to the grinding portion 114.

A plurality of plates 146 are coupled to the tray 134 and are structured to convey material received in the tray 134 from the first end 142 to the second end 144 of the tray 134 and into the grinding portion 114 to be reduced to particulate form by the grinding portion 114. The plurality of plates 146 will be described further with reference to FIG. 4A and FIG. 4B. In some embodiments, the plurality of plates 146 are replaced by other structures, devices, systems, and methods for advancing material in the tray 134 from the first end 142 to the second end 144. In some non-limiting examples, the system 100 may include a belt conveyor, a chain conveyor, a ram plate, one or more augers, and one or more vibrators or oscillators (i.e., use of vibratory action via corresponding structures), among other like alternatives, to push material from the first end 142 towards the second end 144.

Further, the grinding portion 114 has an opening 115 that is connected to the second end 144 of the tray 134 with the grinding portion 114 receiving material from the tray 134 through the opening 115. In some embodiments, the system 100 includes flaps 117 coupled to an enclosed portion of the feed tray 134 proximate the opening 115, that can be rotated or manipulated to cover the opening 115. The flaps 117 may be coupled to the enclosed portion of the feed tray 134 only on one side of the flap 117 in some embodiments with the free end extending toward the tray 134 to allow material to pass through the flaps 117. In one or more embodiments, the flaps 117 are coupled to the tray 134 at multiple points. The flaps 117 reduce the risk of injury or harm to operators near the system 100 by preventing particulate material from the grinding portion 114 from being projected through the opening 115 and toward the first end 142 of the tray 134. The number and arrangement of the flaps 117 can be selected and may include only one flap 117, two flaps 117 as shown in FIG. 3A, or more than two flaps 117, such as three, four, five, six, seven, eight, nine, ten, or more flaps 117.

Figure 3B:
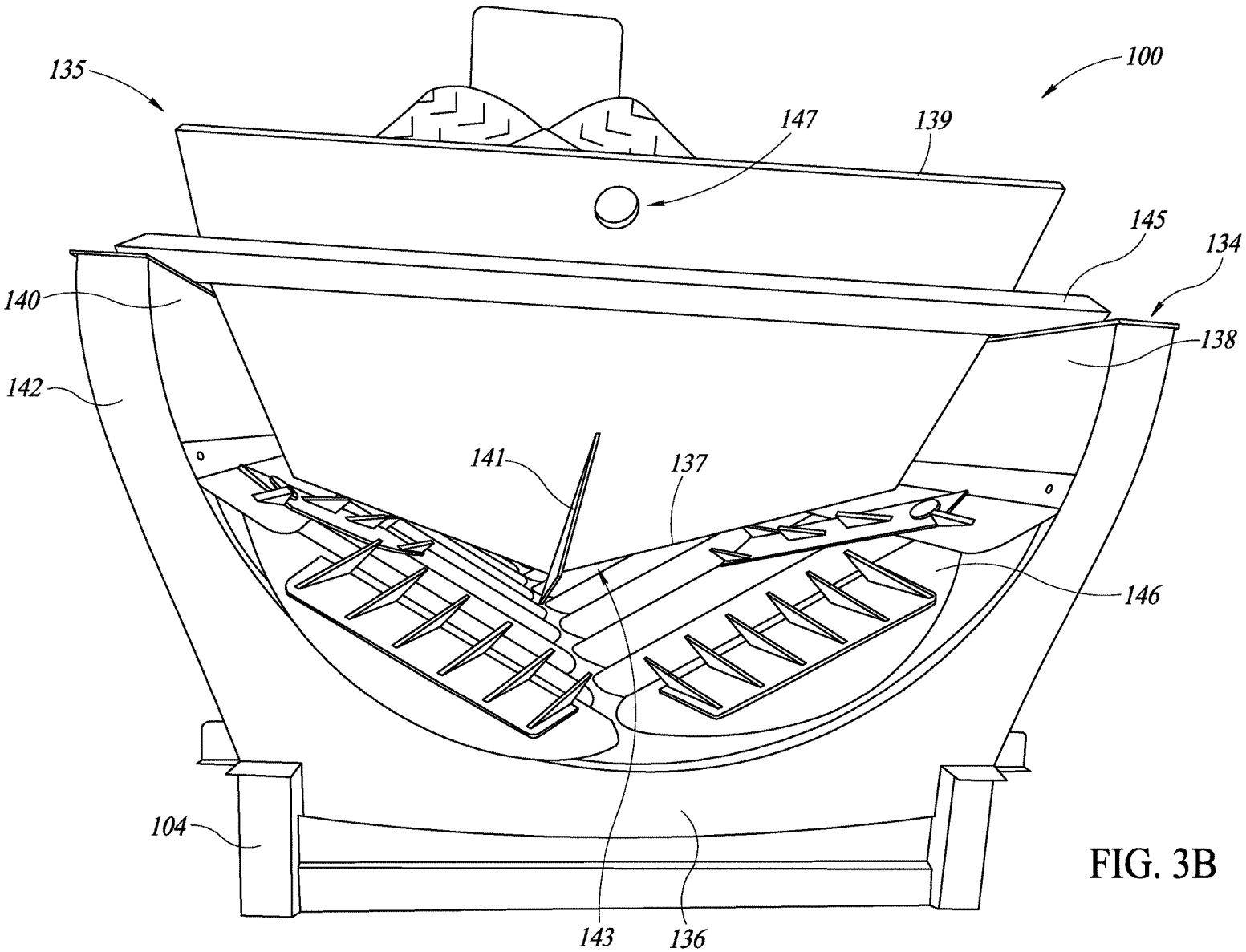
FIG. 3B is a rear elevational view of the tray of the system of FIG. 1 with a mulch plate in the tray for grinding particulate material to mulch.

FIG. 3B illustrates that the system 100 may further include a mulch plate 135 (which may also be referred to herein as a slant plate 135 or a mulching insert 135) received in the tray 134 for grinding particulate material to a smaller size, such as for reducing particulate material to mulch or a finer grade particulate. In one non-limiting example, the mulch plate 135 is a flat and planar plate with a first side 137 having a shape that generally corresponds to a shape of the tray 134. The mulch plate 135 is removably coupled to the tray 134 with the first side 137 coupled proximate a center of the tray 134 (or the second 144 of the tray 134 in some embodiments) and feeding into the opening 115 (FIG. 3A) and a second side 139 of the mulch plate 135 opposite the first side 137 that is slanted away from the opening 115 (FIG. 3A) and positioned proximate the first end 142 of the tray 134.

The mulch plate 135 further includes a flange 141 (which may be referred to as a support plate 141, a spacing plate 141, or a protrusion 141) coupled to the mulch plate 135 and extending from the first side 137 of the mulch plate 135. As shown in FIG. 3B, the flange 141 intersects and extends into a body of the mulch plate 135 at a central vertex or outer point of the first side 137 and also extends away from the body of the mulch plate 135. The shape and arrangement of the flange 141 provides an air gap or space 143 between the first side 137 of the mulch plate 135 and the base 136 of the tray 134 and the plates 146 in the tray 134, such that the mulch plate 135 does not interfere with oscillation of the plates 146. Moreover, the flange 141 may be received directly on the base 136 in some embodiments, or may be received in a correspondingly shaped hole, cavity, or aperture in the base 136 of the tray 134 to assist with securing the mulch plate 135 to the tray 134.

The mulch plate 135 also includes a cross bar 145 (which may also be referred to as a support 145 or a joist 145) that extends across an entirety of the mulch plate 135 and beyond outer peripheral edges of the body of the mulch plate 135 to engage the sidewalls 138, 140 of the tray 134. The cross bar 145 is positioned between the first and second sides 137, 139 of the mulch plate 135, and is positioned closer to the second side 139 in some embodiments in order to support the mulch plate 135 on the sidewalls 138, 140 of the tray 134. A centrally positioned hole 147 extends through the mulch plate 135 proximate the second side 139 to assist with moving and installing the mulch plate 135 with a fork lift or other machinery.

A method of grinding bulk material into particulate material and then into mulch thus includes grinding bulk material into particulate material as described herein. Then, the mulch plate 135 is attached to machinery via hole 147 and is installed with the first side 137 inserted into the tray 134 and the second side 139 supported by the sidewalls 138, 140 of the tray 134 via cross bar 145. The mulch plate 135 is uncoupled from the machinery used to move the mulch plate 135 and the particulate material is fed into the tray 134 along a surface of the mulch plate 135 and facing the grinding portion 114. The mulch plate 135 is slanted towards the grinding portion 114 and may feed directly into the grinding portion 114 in some embodiments. Thus, the mulch plate 135 overcomes certain challenges with moving particulate material with the plates 146 described herein by bypassing the plates 146 and a majority of the tray 134 and feeding particulate material more directly into the grinding portion 114 to be reduced to a smaller size or grade, such as mulch in one non-limiting example.

As such, the mulch plate provides additional functionality for the system 100 that is an advantage over conventional systems, namely the ability to grind particulate material into mulch or fine material (i.e., a wider range of output material size overall) with the same system 100. Moreover, the system 100 is portable such that the operator can select to grind particulate material to mulch at the same site location where the bulk material is ground to particulate material, or the operator can transport the system 100 to a different processing location for grinding the particulate material into mulch. Thus, the system 100 provides flexibility for the operator to select from a wider range of output material size as well as the grinding or processing locations, which are distinct advantages over legacy grinders.

Figure 4A:
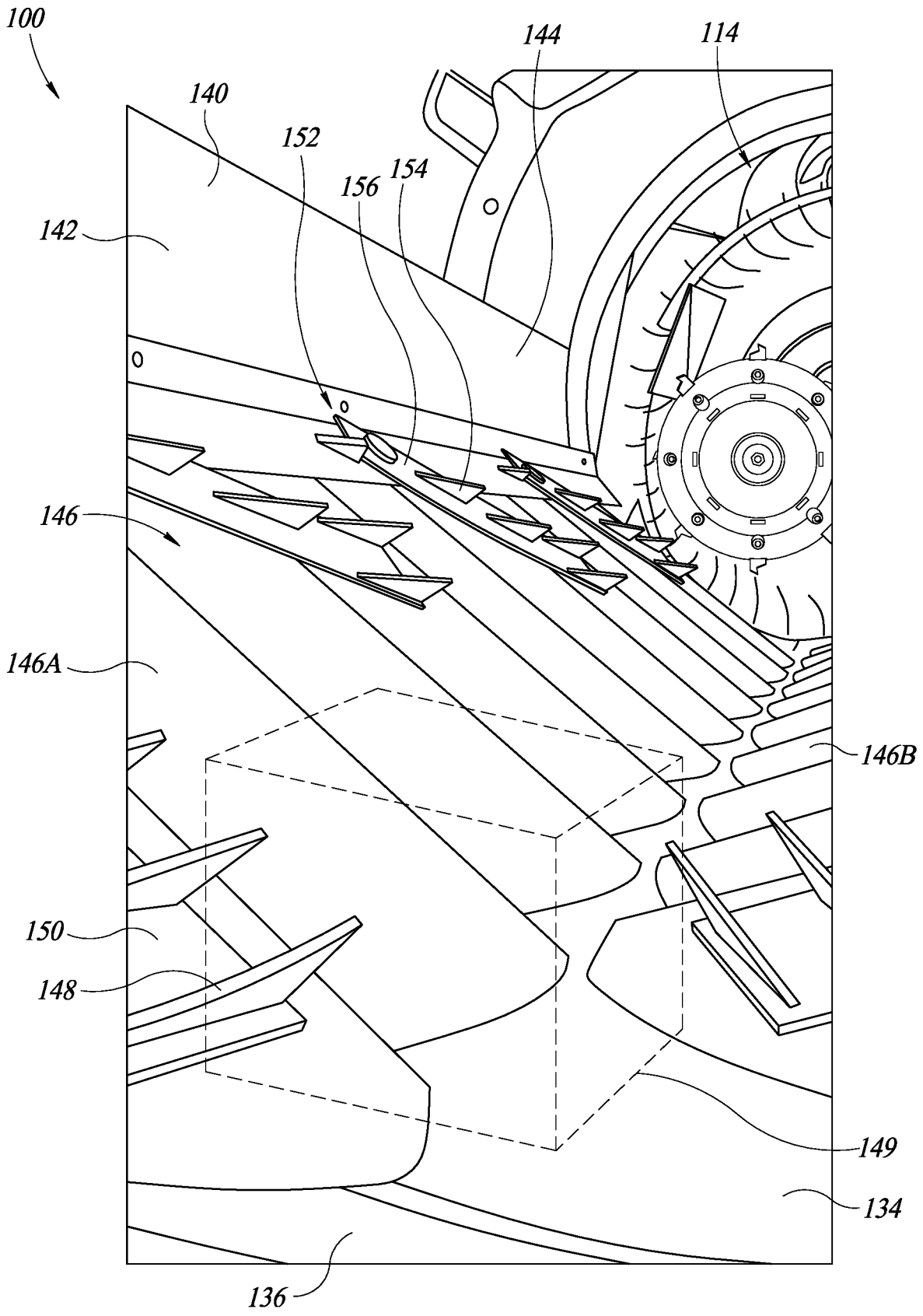
FIG. 4A is a partial elevational view of plates coupled to the tray of FIG. 3A with the plates in a first position.
Figure 4B:
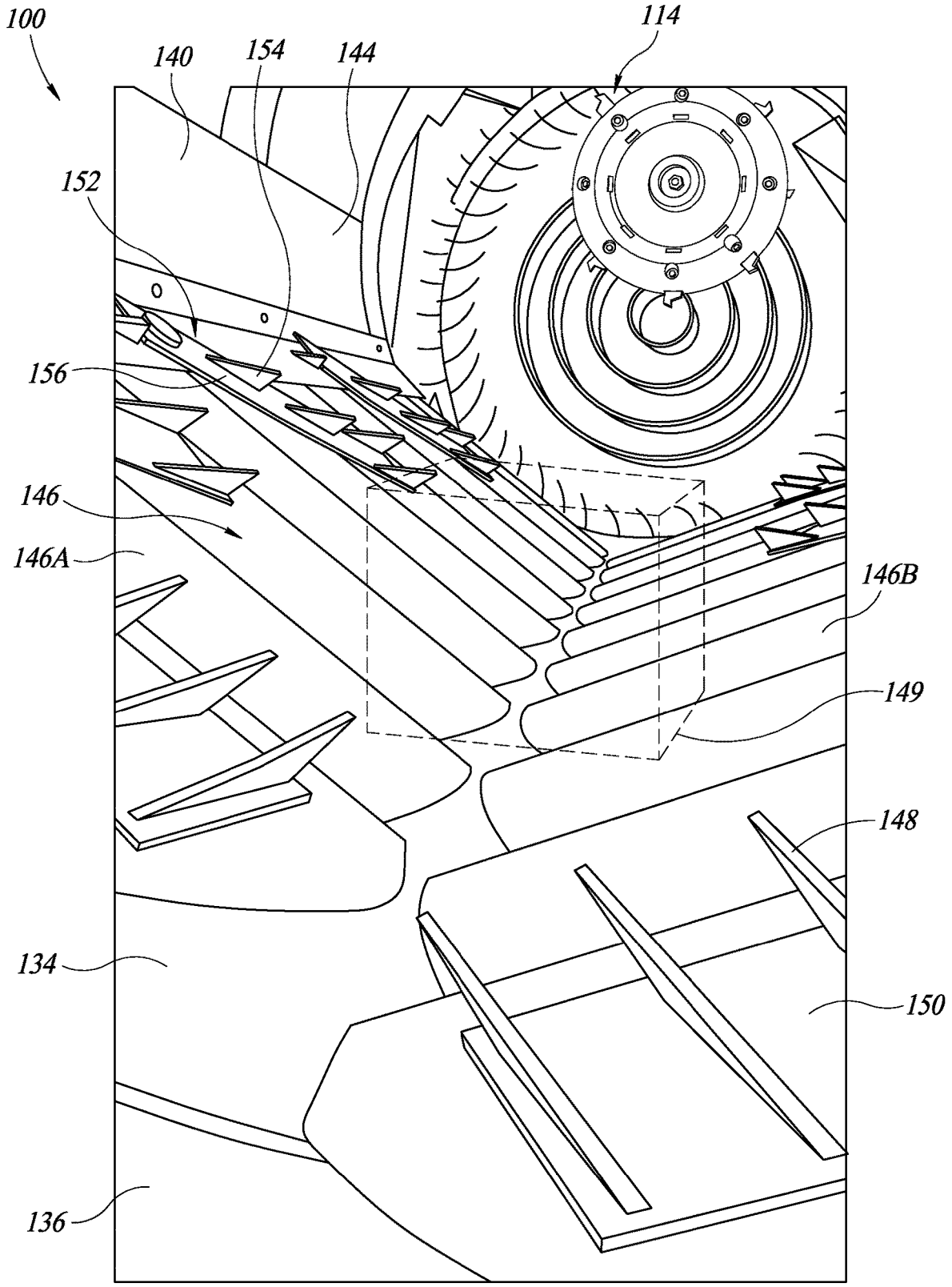
FIG. 4B is a partial elevational view of plates coupled to the tray of FIG. 3A with the plates in a second position.

FIG. 4A and FIG. 4B are partial views of the tray 134 and the plurality of plates 146. In particular, the plates 146 are in a first position in FIG. 4A and in a second position in FIG. 4B.

With reference to FIG. 4A and FIG. 4B and with continuing reference to FIG. 3, the plurality of plates 146 include a first row of plates 146A and a second row of plates 146B aligned parallel to each other and with a small gap between the two rows 146A, 146B in some embodiments, although the same is not required. In one or more embodiments, there may be a selected number of rows of plates, such as one, two, or three or more rows, with a selected orientation to each other, such as parallel or transverse or offset. The rows of plates 146A, 146B are coupled to a separate track, plate, support, or tub, or another like structure, that is structured to oscillate to result in oscillation of the rows of plates 146A, 146B relative to each other. In other words, the system 100 includes a drive assembly for producing linear motion of the rows of a support coupled to the plates 146A, 146B that may include one or more motors, gears, actuators, belts, pulleys, and other like structures for movement of the rows of plates 146A, 146B. All of the plates 146 in each row 146A, 146B are structured to move as a respective unit, meaning that each entire row 146A, 146B is structured to move toward and away from the grinding portion 114, in some embodiments. In one or more embodiments, only selected ones of the plates 146 are structured to move, or a selected row of plates 146A, 146B are structured to move.

Further, the plates 146 in each row 146A, 146B may be spaced 14 inches from each other on center or edge to edge with a controllable or adjustable speed through 16 inches of travel. Thus, the total range of travel between the two rows 146A, 146B is 32 inches in some embodiments. It is to be appreciated that the spacing of the plates 146 and the range of travel of each row 146A, 1466 can be selected to more or less than the above values in one or more embodiments. For example, the spacing of the plates may be any value less than 1 inch up to 14 inches and greater than 14 inches up to 28 inches or more. Similarly, the range or travel distance of each row 146A, 146B can be any value less than 1 inch up to 16 inches and greater than 16 inches up to 32 inches or more. In one or more embodiments, the rows of plates 146A, 146B are arranged at an angle to the base 136 of the tray 134 such that the plates form a "V" shape. The angle of the rows of the plates 146A, 146B relative to a horizontal plane including the base 134 may be selected to be any value between and including 0 degrees and 90 degrees. As such, the plates 146 provide a continuous linear taper between the sidewalls 138, 140 and the base 136 of the generally round or curved tray 134 in some embodiments.

In some embodiments, at least one of the plates 146 includes a plurality of teeth 148 coupled to the plate 146 to assist with moving the material. The plurality of teeth 148 may be coupled to a support 150, such as a plate, that is coupled to the selected one of the plates 146 or the teeth 148 may be coupled directly to the plates 146. The teeth 148 and support 150 combination may be referred to herein as an end feeder. In some embodiments, and as shown in FIG. 3, the plurality of teeth 148 may be coupled only to the last or terminal plate or plates of the plurality of plates 146 at the first end 142 of the tray 134. In other words, only the last plate 146 in each row 146A, 146B proximate the first end 142 of the tray 134 may include the teeth 148 in order to prevent material from falling out of the tray 134 at the first end 142 during oscillation of the plates 146 in some embodiments. In one or more embodiments, the teeth 148 are coupled to selected ones of any of the plates 146.

The system 100 may further include a plurality of side feeders 152 coupled to the sidewalls 138, 140 of the tray 134. The side feeders 152 may include a plurality of teeth 154 coupled to a support 156, which may be a plate, coupled to the sidewalls 138, 140. The number and arrangement of side feeders 152 may be selected, but as shown in FIG. 3, the system 100 may include six side feeders 152 with three side feeders 152 coupled to each sidewall 138, 140 of the tray 134. Further, the side feeders 152 may be arranged at a selected angle between and including 0 and 180 degrees from the first end 142 of the tray 134 toward the second end 144 of the tray 134 in order to assist with ratcheting the material in the tray 134 forward to the grinding portion 114.

In some embodiments, the side feeders 152 move with the corresponding row of plates 146A, 146B and more particularly, the side feeders 152 on the left side of the tray 134 in the orientation shown in FIG. 4A and FIG. 4B move with the first row of plates 146A and the side feeders 152 on the right side of the tray 134 move with the second row of plates 146B. The side feeders 152 may be driven by the same drive assembly and move at the same speed as the rows of plates 146A, 146B or the side feeders 152 may be independently driven and selected to move at a different speed than the rows of plates 146A, 146B. In some embodiments, the side feeders 152 on each side of the tray 134 move at half of the speed of the plates 146 because the side feeders 152 on each side of the tray 134 only move with the corresponding rows of plates 146A, 146B. Thus, while the plates 146 move through 32 total inches of travel, the side feeders 152 on each side of the tray 134 will move 16 inches.

In one or more embodiments, the side feeders 152 are coupled to the sidewalls 138, 140 only at one end of the side feeders 152 and the side feeders 152 are not structured to move with the plates 146. Thus, the other end of the side feeders 152 floats or rests on top of the plates 146 to allow the plates 146 to slide underneath the side feeders 152. In other words, the side feeders 152 are stationary and have one free end that slides over the plates 146 to avoid inhibiting the motion of the plates 146 in some embodiments. The side feeders 152 assist with ratcheting material when a large volume of material is placed in the tray 134 and may cause material to be fed at half of the rate of the plates 146 by preventing backward motion of the material. Thus, the material moves forward relative to the side feeders 152 when the corresponding plates 146A, 146B move forward and the material will be stationary relative to the side feeders 152 when the corresponding plates 146A, 146B move backward. With a large volume of material, the portions of the material proximate the sidewalls 138, 140 of the tray 134 (or the sides of the material volume) may not be moved by the rows of plates 146A, 146B because of the position of the plates 146 at the bottom of the volume of material. The side feeders 152 engage sides of the volume of the material and assist with pushing the material forward via the rows of plates 146A, 146B.

In FIG. 4A, the rows of plates 146A, 146B are illustrated in a first position with the first row of plates 146A positioned closer to the first end 142 of the tray 134 than the second row of plates 146B. The first position shown in FIG. 4A may illustrate one end of the range of motion of the rows of plates 146A, 146B or a maximum extension of the first row 146A and a maximum retraction of the second row 146B. In FIG. 4B, the rows of plates 146A, 146B are illustrated in a second position with the second row of plates 146B positioned closer to the first end 142 of the tray 134 than the first row of plates 146A. Thus, the second position in FIG. 4B may illustrate an opposite end of the range of motion of the rows of plates 146A, 146B or a maximum retraction of the first row 146A and a maximum extension of the second row 146B.

The rows of plates 146A, 146B continuously move during operation of the system 100 to ratchet material in the tray 134 forward to the grinding portion 114. For example, FIG. 4A and FIG. 4B provide a schematic illustration of bulk material 149 to illustrate operation of the rows of plates 146A, 146B. In FIG. 4A, the bulk material 149 is inserted into the tray 134 proximate the first end 142 of the tray 134 with the first row of plates 146A extended away from the grinding portion 114 and the second row of plates 146B retracted toward the grinding portion 114. As the rows of plates 146A, 146B oscillate between the first position in FIG. 4A and the second position in 4B, the first row of plates 146A pushes the bulk material 149 toward the grinding portion 114 while the second row of plates 146B simultaneously moves away from the grinding portion 114 and slides underneath the material 149 to prevent the material 149 from stalling in the tray 134.

Thus, in FIG. 4B, the material 149 is illustrated as being closer to the grinding portion 114 via movement of the first row of plates 146A toward the grinding portion 114 and the second row of plates 146B away from the grinding portion 114. As the rows of plates 146A, 146B oscillate from the second position in FIG. 4B and back to the first position in FIG. 4A to complete a cycle, the second row of plates 146B pushes the bulk material 149 towards the grinding portion 114 while the first row of plates 146A moves away from the grinding portion 114 and slides underneath the bulk material 149. This process is repeated to continuously feed material 149 into the grinding portion 114 by preventing backward movement of the bulk material 149.

Movement of the bulk material 149 is assisted in some embodiments by the shape and arrangement of the plates 146. As shown in FIG. 4A and FIG. 4B, each plate 146 may have a leading edge (i.e., the edge facing the grinding portion 114) that is a flat sidewall that is substantially perpendicular to a plane containing the base 136 of the tray 134 and a trail edge (i.e., the edge facing away from the grinding portion 114) that is tapered to be closer to parallel with the plane containing the base 136 of the tray 134. Further, the plates 146 overlap each other such that the leading edge of each plate 146 is positioned on a successive plate 146 and is thus spaced further or higher from the base 136 than the trail edge. As the rows of plates 146A, 146B oscillate as above, the leading edge of the first row of plates 146A engages the bulk material 149 as the first row of plates 146A moves toward the grinding portion 114 while the trail edge of each of the second row of plates 146B is shaped and oriented to simultaneously slide underneath the material 149. The same is true in reverse for the second row of plates 146B moving towards the grinding portion 114 and the first row of plates 146A moving away from the grinding portion 114 in the oscillation cycle. The shape, orientation, and oscillation of the plates 146 also engages the material 149 to move it forward but does not snag on the material 149 like chain or belt driven systems because the plates 146 disengage from the material 149 as the plates 146 move away from the grinding portion 114. Further, the plates 146 may be steel or another selected metal and thus have improved durability over known chain or belt driven systems.

The end feeders 148, 150 and the side feeders 152 further assist the movement of the material 149. The end feeders 148, 150 engage material at the first end 142 of the tray 134 to prevent material from falling out of the tray 134 during movement of the plates 146 while the side feeders 152 engage sides of the material 149 to assist with moving larger volumes of material 149. In some operational situations where a large volume of material 149 is input to the tray 134, the oscillation of the plates 146 may not exert enough force on the material 149 to move the sides of the material 149 due to the weight of the material 149, or the plates 146 may move the bottom of the material 149 out from underneath the sides of the material 149 which can cause the sides of the material 149 to move away from the grinding portion 114. The side feeders 152 engage the sides of large volumes of material 149 and prevent them from moving away from the grinding portion 114, or prevent the plates 146 from pulling only the bottom of the material 114 forward. As explained above, the side feeders 152 may oscillate with the rows of plates 146A, 146B or may be stationary in various embodiments. Thus, the end feeders 148, 150 and the side feeders 152 enable the system 100 to grind larger volumes of bulk material 149 than conventional grinding systems.

Figure 5A:
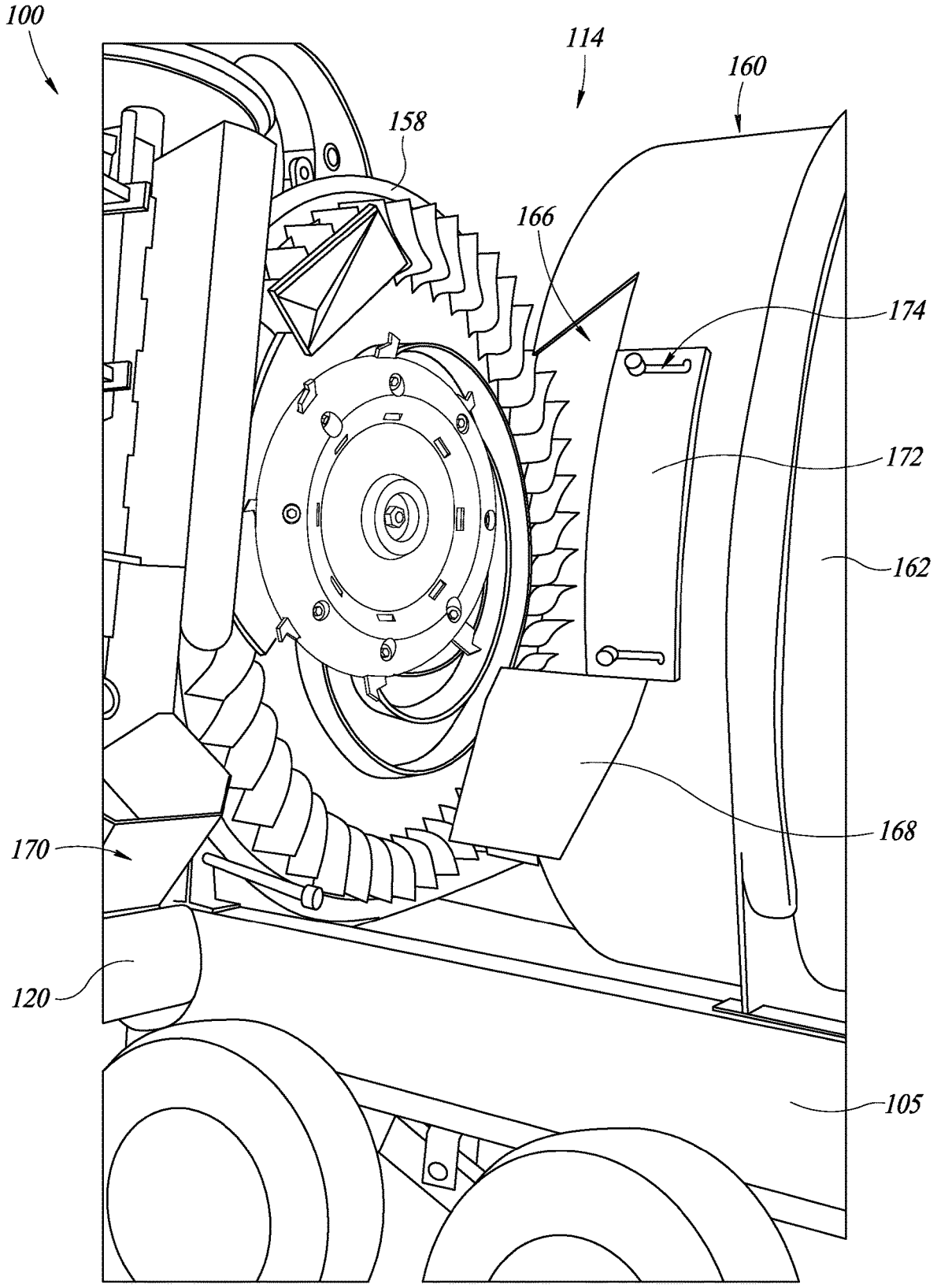
FIG. 5A is a perspective view of a grinding portion of the system of FIG. 1 including a grind hub and a grind ring in a first position.
Figure 5B:
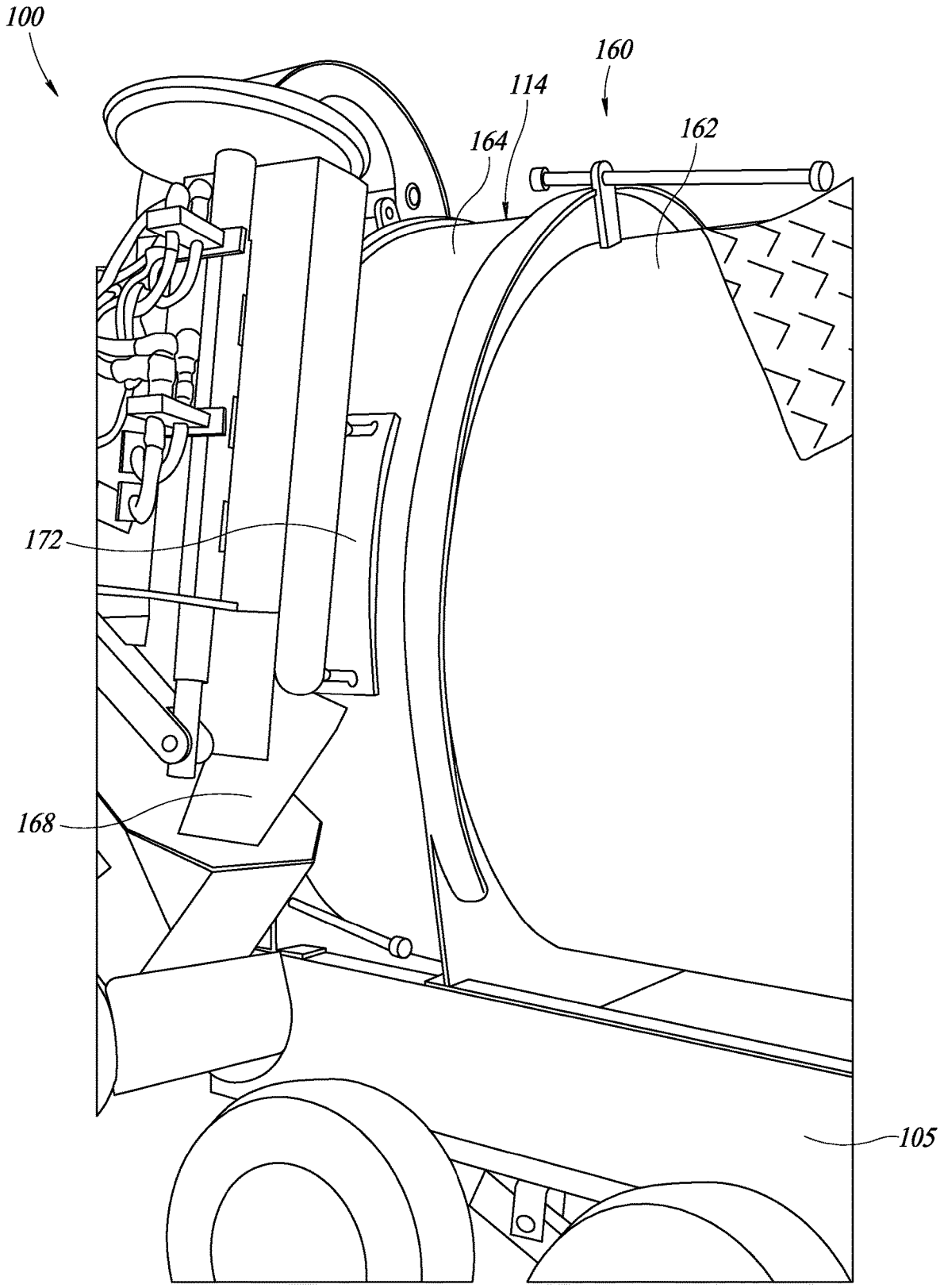
FIG. 5B is a perspective view of the grinding portion of the system of FIG. 1 including the grind hub and the grind ring in a second position.

FIG. 5A and FIG. 5B illustrate the grinding portion 114 of the system 100 in more detail. With reference to FIG. 5A and FIG. 5B, the grinding portion 114 includes a grind hub 158 and a grind ring 160 that are both coupled directly or indirectly to the trailer 102 and the frame 104. As explained below, the grind hub 158 also includes a grind plate (see grind plate 190 in FIG. 8). In some embodiments, the grind ring 160 is bolted directly to the tray 134 and the grind ring 160 and tray 134 assembly are structured to slide as a single unit along frame rails 105 of the frame 104 to engage the grind hub 158 and the grind plate 190. The grind hub 158 is described in additional detail with reference to FIGS. 7-9 and the grind ring 160 is described in additional detail with reference to FIG. 6. As explained further below, components of the grind hub 158 are structured to rotate and the grind ring 160 (along with the tray 134) is structured to slide to engage the grind hub 158. In particular, FIG. 5A and FIG. 5B are provided to demonstrate the sliding motion of the grind ring 160 and the tray 134 and how a user can control the output size of the particulate material.

Beginning with FIG. 5A, the grind ring 160 is coupled to or bolted to the tray 134 such that the grind ring 160 and tray 134 assembly moves as a single, integral unit, to provide access to the grind hub 158. More specifically, an enclosed portion 162 of the grind ring 160 is coupled to the tray 134 or the enclosed portion 162 of the grind ring 160 may be a single, integral, unitary part of the tray 134. Thus, the tray 134 is also structured to slide relative to the trailer 102 and the frame 104 along frame rails 105 in some embodiments.

The enclosed portion 162 of the grind ring 160 generally has a hollow cylindrical shape and encloses the tray 134 at the second end 144 of the tray 134 (FIG. 3). The grind ring 160 is shown in FIG. 5A in a first position in which the enclosed portion 162 of the grind ring 160 and the tray 134 are at least partially slid away from the grind hub 158 such that the grind hub 158 is exposed to an external environment. The first position may correspond to a storage or inactive configuration of the system 100. In some embodiments, the first position corresponds to a maintenance or service configuration. In other words, the enclosed portion 162 of the grind ring 160 and the tray 134 may at least partially slide away from the grind hub 158 only for maintenance or service on the system 100 in some embodiments. Further, with the grind ring 160 in the first position shown in FIG. 5A, a user can access the grind hub 158, the grind ring 160, and other internal components of the grinding portion 114 shown in FIG. 5A for maintenance, cleaning, or repair or replacement of various components. Other configurations for the enclosed portion 162 and the tray 134 are also contemplated herein for providing access to the grind hub 158.

The enclosed portion 162 of the grind ring 160 includes an outlet 166 through the body 110 on one side of the enclosed portion 162 facing the grind hub 158. In some embodiments, the outlet 166 defines an outlet of the grind hub 158 and of the grinding portion 114 of the system 100 generally. As explained further below, the size of the outlet 166 is adjustable to vary the output material size. A larger outlet 166 size will allow larger particulate material to be output by the system 100 to the output conveyor 118 while a smaller outlet 166 size will create smaller particulate matter. The output material is transferred to an inlet 170 at the first end 120 of the output conveyor 118 (FIG. 2A) by an outlet plate 168 (which may also be referred to herein as a slide plate 168) coupled to the enclosed portion 162 of the grind ring 160.

In one or more preferred embodiments, the outlet 166 may be adjustable by moving a plate 172 that is positioned adjacent or proximate to the outlet 166. The plate 172 is coupled to the enclosed portion 162 with fasteners and includes a track or channel 174 for adjusting a position of the plate 172 relative to the enclosed portion 162. Adjusting the position of the plate 172 also changes the size of the outlet 166 to provide control over the size of the output particulate matter. As illustrated, the plate 172 slides relative to the grind ring 160 in a lateral or horizontal direction toward or away from the grind hub 158 to selectively control the size of the outlet 166 and the particulate material. In some embodiments, the plate 172 has a similar functionality but slides vertically relative to the grind ring 160. Thus, a user can select the size of the particulate matter output by the system by varying the size of the outlet 166 by adjusting the plate 172. Other concepts for controlling the size of the output material are contemplated herein, such as adjusting a position of the enclosed portion 162 and the tray 134 relative to the grind hub 158, or with a different plate assembly and configuration.

In FIG. 5B, the second portion 164 is illustrated as being engaged with the grinding portion 114 and also covering the grind hub 158 (FIG. 5A) to reduce the risk of injury from particulate material. As noted above, the portions 162, 164 of the grind ring 160 and the tray 134 move as a single integral unit along frame rails 105 of the frame 104 in some embodiments. The grind ring 160 and the tray 134 may be mechanically connected to a drive assembly including various gears, motors, pulleys, belts, actuators and other like structures for driving the grind ring 160 and tray 134 combination. The drive assembly for the grind ring 160 and tray 134 may be connected to user operable controls, such as joy sticks and levers or other like structures, for adjusting a position of the grind ring 160 and tray 134 along frame rails 105. Although the tray 134 is not visible in FIG. 5A and FIG. 5B, these figures illustrate a full range of motion of the grind ring 160 and tray 134 in some embodiments. In FIG. 5A, the grind ring 160 is in the first or fully retracted position and in FIG. 5B, the grind ring 160 is manipulated toward the grinding portion 114 via the drive assembly to a fully extended position in which the grind ring 160 engages the grinding portion 114 and the grind hub 158. It is to be appreciated that the position of the grind ring 160 and tray 134 is selectable by the operator to be any position between these two points.

Figure 6:
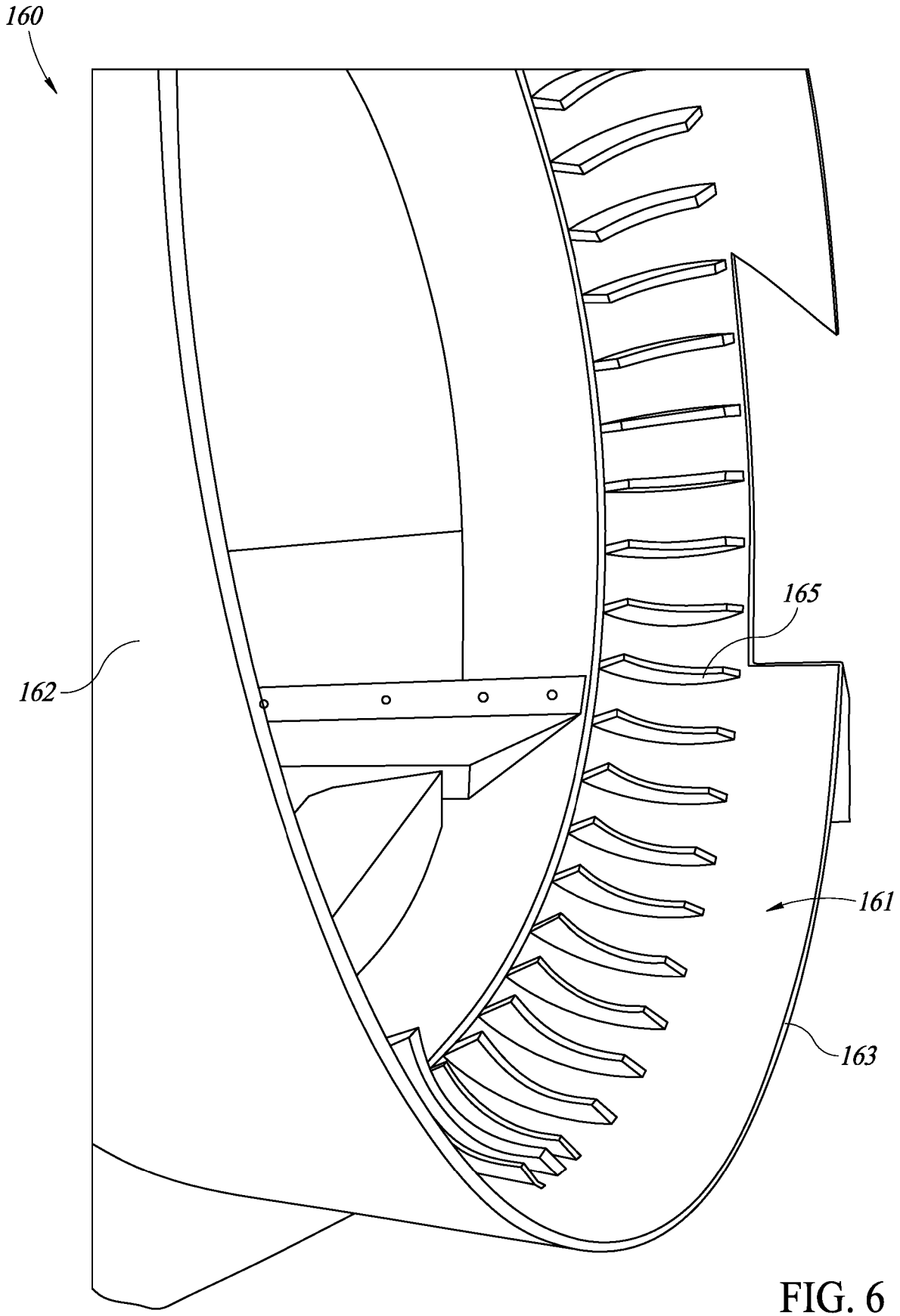
FIG. 6 is a perspective view of an internal portion of the grind ring of the system of FIG. 1.

FIG. 6 illustrates additional details of the grind ring 160. For example, FIGS. 5B and 6 show a view of the inside of the second portion 164 of the grind ring 160 that engages the grind hub 158. The second portion 164 includes an interior surface 161 and an outer peripheral edge 163 bounding the interior surface 161. The interior surface 161 and the outer peripheral edge 163 extend toward the grind hub 158 and engage a corresponding socket on the grind hub 158 to couple the grind ring 160 to the grind hub 158. Further, the grind ring 160 includes a plurality of anvils 165 (which may also be referred to herein as a plurality of teeth 165 or a plurality of splines 165) coupled to the interior surface 161 and positioned proximate the outer peripheral edge 163. As shown in FIG. 6, the anvils 165 may extend around an entirety of a circumference or other like dimension of the interior surface 161 of the second portion 164 of the grind ring 160 with equidistant spacing between the anvils 165, in some embodiments. In one or more embodiments, the anvils 165 have a different spacing and may not extend around an entirety of the interior surface 161. The anvils 165 provide a structure for the grind hub 158 to work against and may also assist with engaging the second portion 164 with the socket of the grind hub 158.

Figure 7:
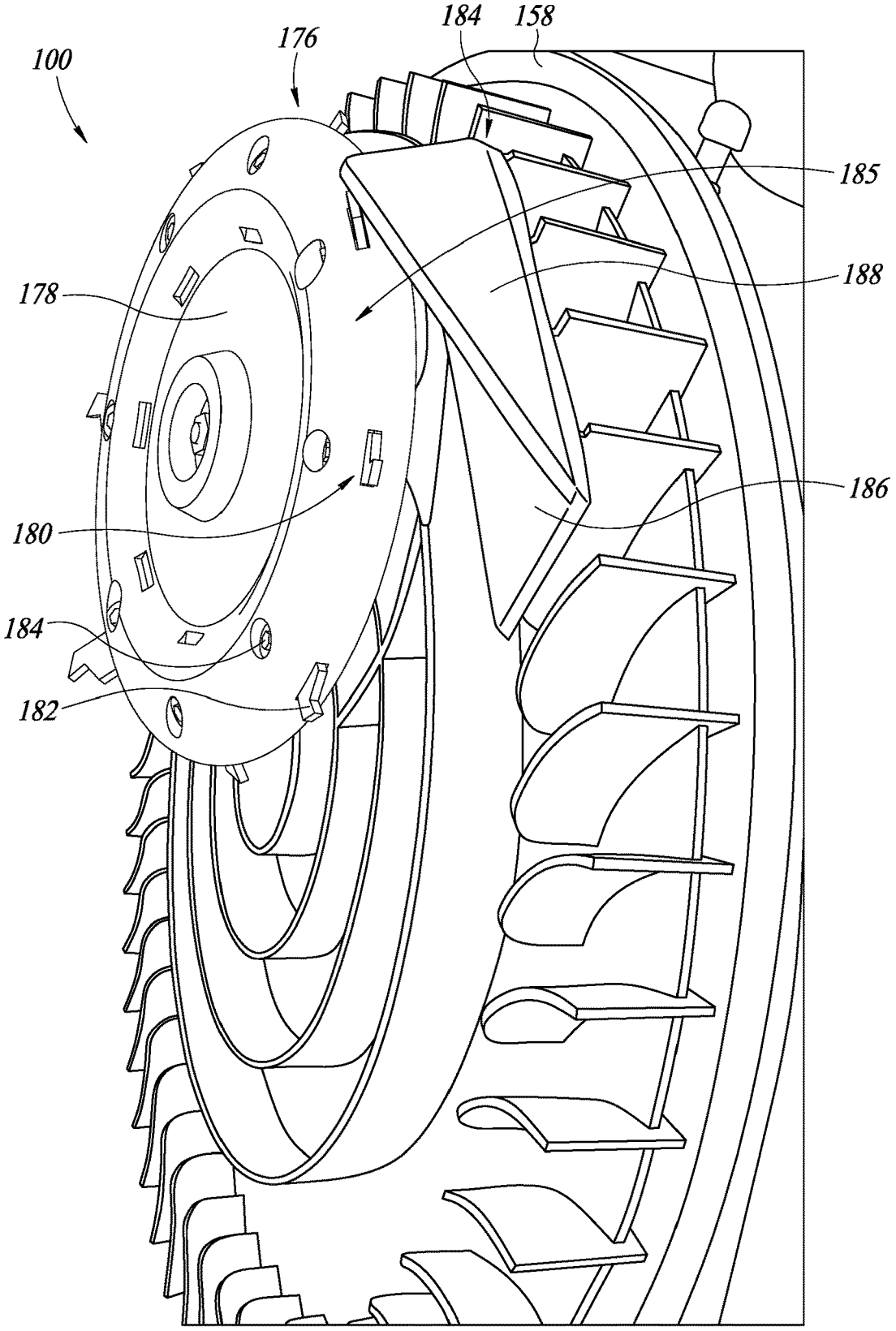
FIG. 7 is a perspective view of a cutter disk of the system of FIG. 1 coupled to the grind hub.

FIG. 7 illustrates the grind hub 158 of the system 100 in more detail and in particular, illustrates a cutter disk 176 coupled to the grind hub 158. The cutter disk 176 includes a disk plate 178 and a plurality of holder blocks coupled to the disk plate 178. More specifically, the holder blocks are internal to the cutter disk 176 and are welded to the disk plate 178 in some embodiments. The cutter disk 176 further includes openings 180 and a plurality of impact cutter blades 182 coupled to the holder blocks with blade bolt assemblies 184. The cutter blades 182 extend through the openings 180 and away from an outer circumferential surface 185 of the cutter disk 176. Thus, the cutter disk 176 is a welded assembly that eliminates bolted connections and slugs in some embodiments, which may improve performance and reliability.

In some preferred embodiments, the cutter blades 182 are each arranged at a selected offset angle from a vertical plane through a center of the cutter disk 176. While it is contemplated herein that the selected offset angle may be the same for each cutter blade 182, it is has been found that selecting a different offset angle for each blade 182 improves cutting efficiency. Thus, the blades 182 do not extend vertically from the cutter disk 176 in a straight line around a circumference of the cutter disk 176, but are each at a different angle relative to each other and the cutter disk 176 in some embodiments. In some non-limiting examples, the offset angle of each blade 182 relative to the vertical plane through the center of the cutter disk 176 is less than 1 degree, 1 degree, 2 degrees, 3 degrees, 4 degrees, 5 degrees, 6 degrees, 7 degrees, 8 degrees, 9 degrees, 10 degrees, 15 degrees, 20 degrees, 25 degrees, 30 degrees, or 45 or more degrees. The offset angle may also be positive or negative (i.e., to the right or left of, or in front of or behind the vertical plane) as well as any value between those listed above. The cutter disk 176 may also have any selected number of blades 182 in a selected spacing and arrangement around the cutter disk 176. In some non-limiting examples, the cutter disk 176 includes any number of blades between 1 blade and up to 20 or more blades 182. The blades 182 may each be spaced from each other by an equal distance or by a different distance, or may be positioned adjacent each other.

The offset angle of the blades 182 relative to the cutter disk 176 and to each other improves cutting efficiency because the blades 182 cut a wider swath out of the material 149 as it advances. The orientation of the blades 182 also prevents material 149 from being trapped against the cutter disk 176 and assists with processing larger volumes of material. The blades 182 are also replaceable by manipulating the blade bolt assemblies 184 and replacing the blades 182, which reduces maintenance down time and associated costs. The cutter disk 176 is mechanically coupled to an axle structured to rotate the cutter disk 176, as described further below with reference to FIG. 9. It is also contemplated that the cutter disk 176 may be the same as the cutter disk disclosed in U.S. Pat. No. 10,357,776 and pending U.S. patent application Ser. No. 16/508,966, both of which are incorporated herein by reference in their entirety Moreover, the grind hub 158 is structured to rotate in a first plane that is substantially vertical. In this context only, a "substantially" vertical plane means a plane that is within plus or minus 3 degrees of vertical. The cutter disk 176 is coupled to the grind hub 158 at an angle to the grind hub 158 such that the cutter disk 176 rotates in a different plane than the grind hub 158. In particular, the cutter disk 176 rotates in a second plane that is at an offset angle to the grind hub 158 and the first plane between 1 and 10 degrees, or between 1 and 5 degrees, or between 2 and 3 degrees, or more or less. In some non-limiting examples, the angle between the cutter disk 176 and the grind hub 158 is less than one degree, one degree, two degrees, three degrees, four degrees, five degrees, six degrees, seven degrees, eight degrees, nine degrees, or ten or more degrees, inclusive of all values between the whole number integers in the above series.

The cutter disk 176 is arranged at an angle to the grind hub 158 in order to allow the cutter disk 176 to "corkscrew" its way through the grinding material to be ground up. In other words, the cutter disk 176 rotates in a different plane to improve the cutting efficiency of the cutter disk 176 and particularly for large material, such as a large diameter (i.e., a three or four foot diameter) log. If the cutter disk 176 were arranged substantially vertically (i.e., not at an offset angle), an end of the large material to be ground up could become trapped against the cutter disk 176, without the cutter disk 176 being able to work through the material. This would cause the cutter disk 176 to smoke or burn against the end of the material instead of cutting through the material, and thus, would result in the grinding system stalling out. Therefore, while arranging the cutter disk 176 substantially vertical is contemplated here, it has been found that aligning the cutter disk 176 at an angle or offset from the grind hub 158 improves cutting efficiency and particularly for large material.

It is also contemplated herein that the system 100 includes more than one cutter disk 176 to further improve cutting efficiency or processing speed, such as two, three, four, five, six, or more cutter disks 176. Each of the cutter disks 176 may rotate in the second plane described above, or each cutter disk 176 may rotate in their own plane that is at a selected offset angle to the first plane from any of the angles disclosed above. Further, each cutter disk may have the same number of blades 182 in a similar arrangement or may have different numbers of blades 182 per disk with different orientations.

The system 100 further includes a first limiter 184 (which may also be referred to herein as a first limit plate 184) coupled to the grind hub 158. The first limiter 184 includes a base plate 186 and a protrusion 188 extending from the base plate 186. The first limiter 184 is structured to prevent material from being wedged or trapped between the cutter disk 176 and the grind ring 160. The protrusion 188 extends from the base plate 186 at an outermost edge of the base plate 186 and proximate an outermost edge of the grind hub 158 in order to push material away from the outermost edge of the grind hub 158 and the grind ring 160, and towards the infeed tray 134 and the center of the grind hub 158. As shown in FIG. 7, the protrusion 188 has a triangular or pyramidal shape that constantly tapers from a vertex to the base plate 186 although the protrusion 188 may be selected to have any shape. In some embodiments, the first limiter 184 rotates with the grind hub 158 such that the first limiter 184 is stationary relative to the cutter disk 176 and the grind hub 158.

Figure 8:
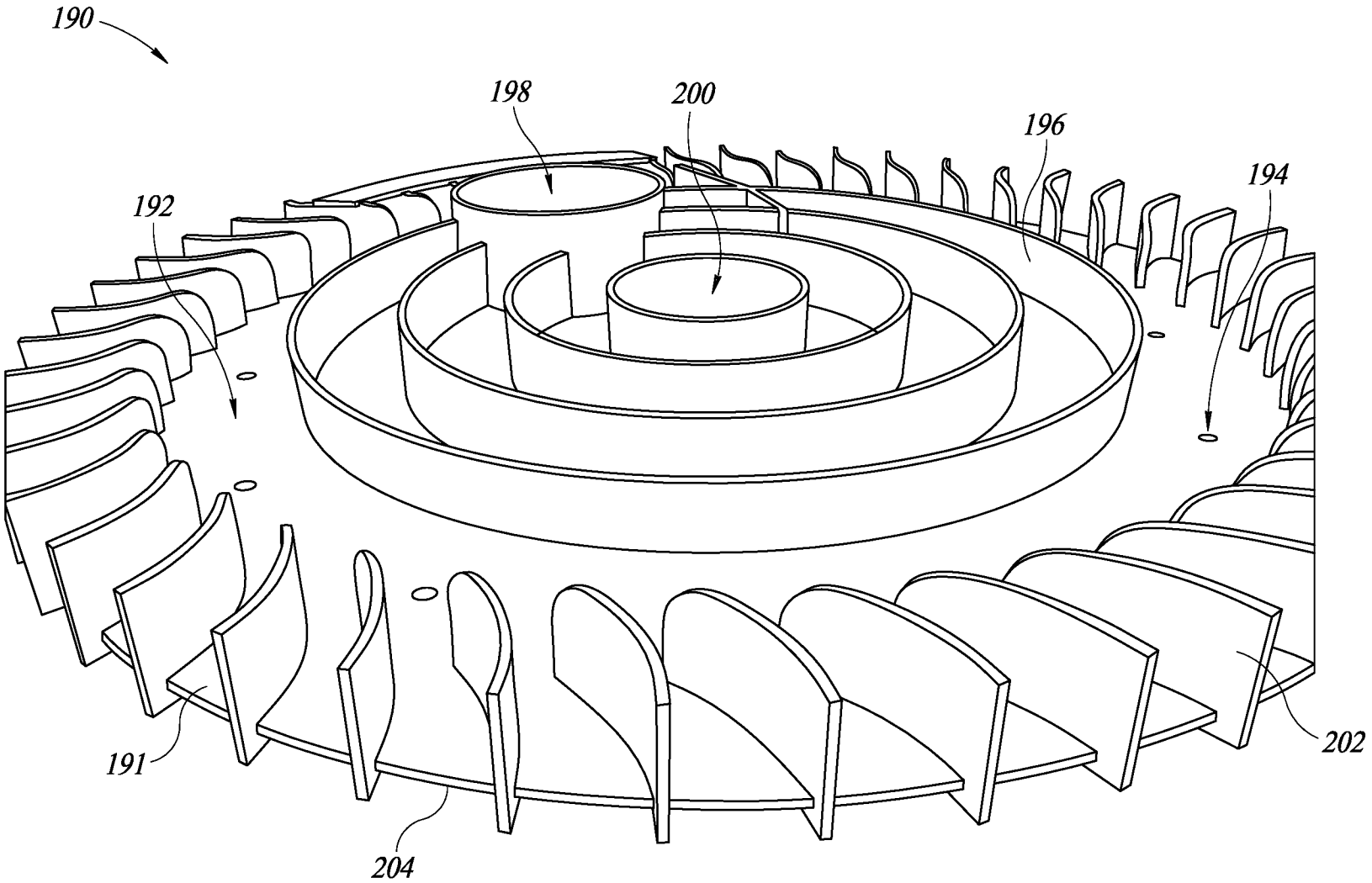
FIG. 8 is a perspective view of a first surface of the grind hub of the system of FIG. 1.
Figure 9:
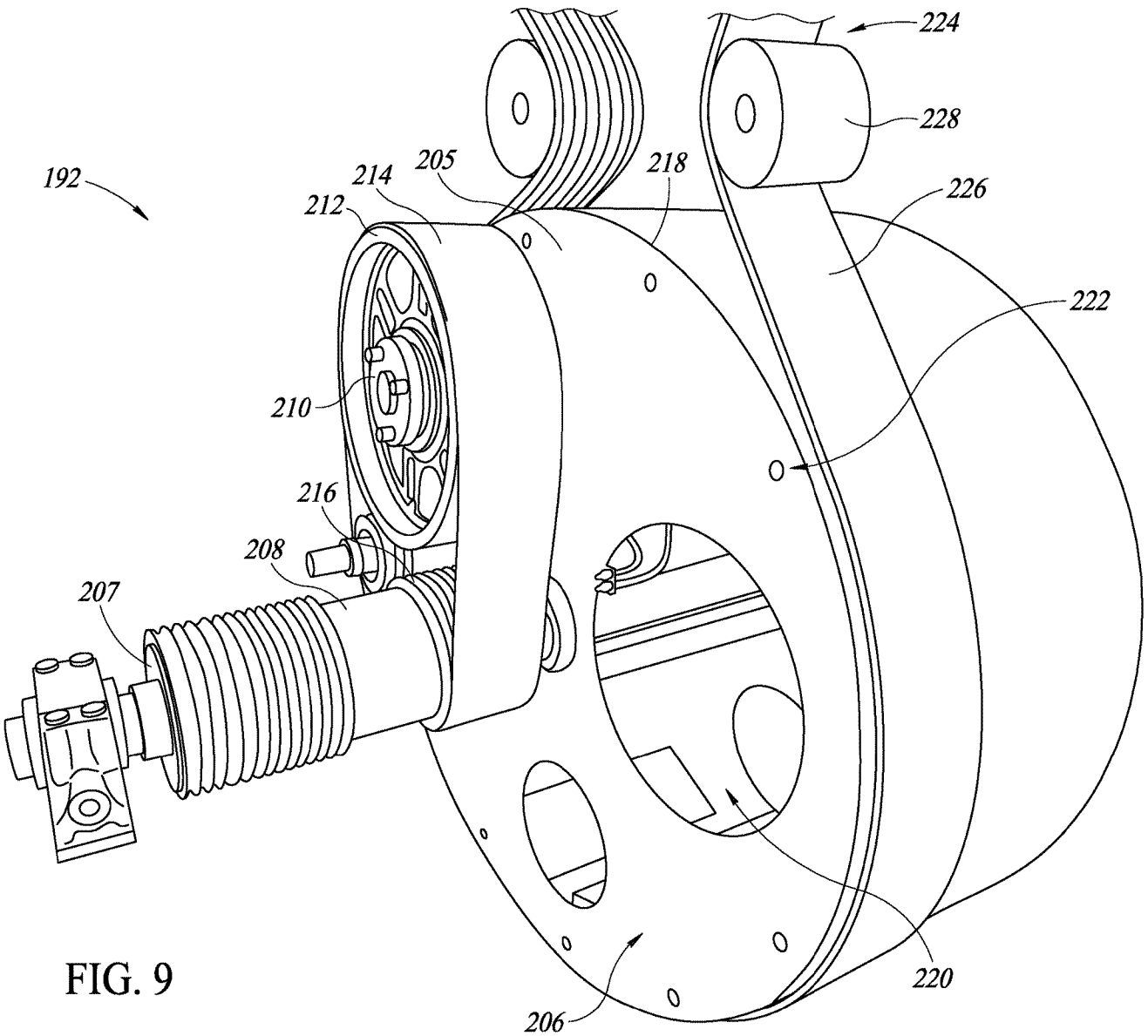
FIG. 9 is a perspective view of a second surface of the grind hub of FIG. 1.

FIG. 8 illustrates a grind plate 190 of the grind hub 158. The grind plate 190 is coupled to a drive hub 192 shown and described with reference to FIG. 9 to form the grind hub 158. The grind plate 190 includes a first side 191 with a first surface 192. The first side 191 and the first surface 192 of the grind plate 190 may also be referred to as the first side 191 and the first surface 192 of the grind hub 158 in the completed grind hub 158 assembly. The grind plate 190 includes a plurality of first holes 194 extending through the first surface 192 that are structured to receive fasteners to couple the grind plate 190 to the drive hub 192 (FIG. 9). In some embodiments, the grind plate 190 is bolted to the drive hub 192 through first holes 194 and seals the drive hub 192 and its bearings and other mechanical components from contamination that is created as the cutter disk 176 cuts the bulk material. Further, the grind plate 190 is removeable and replaceable to assist with service and maintenance.

A second limiter 196 (which may also be referred to herein as a second limit plate 196 or a plurality of second limit plates 196) is coupled to the first surface 192 of the grind plate 190. The second limiter 196 is a sidewall or a plurality of sidewalls extending from the first surface 192 and arranged as a plurality of concentric circles. In some embodiments, the second limiter 196 has a different shape or arrangement, such as a spiral or may include different shapes, such as squares, rectangles, triangles, trapezoids, or others. Further, while FIG. 8 illustrates the second limiter 196 including three circles, the number of circles in the limiter may be selected to be more or less than three circles, such as one, two, four, five, six, seven, eight, nine, ten, or more circles in the limiter 196. Each of the circles of the second limiter 196 may be spaced equidistant from each other or may be selected to have a different spacing from each other.

The second limiter 196 extends from the first surface 192 and sits behind the cutter disk 176 (FIG. 7) relative to the first surface 192 in order to prevent material from passing the cutter disk 176. In other words, the second limiter 196 prevents material from moving too far forward such that the cutter disk 176 hits the side or center of the material. Instead, the cutter disk 176 grinds an end of the material, with the second limiter 196 assisting in positioning the material for grinding. The grind plate 190 further includes a second hole 198 and a third hole 200. The second hole 198 receives an axle for mechanically coupling to the cutter disk 176 to enable rotation of the cutter disk 176 and the third hole 200 receives an axle for mechanical coupling of the grind plate 190 and the drive hub 192 to the axle for rotation of the grind hub assembly 158.

In other embodiments, there are one or more additional cutter disks 176 that are rotatably connected to the grind plate 190 or the drive hub 192, or both, which would each have their own axles and axle holes through the plate 190. The characteristics of the one or more additional cutter disks 176 may be selected according to design factors such as cutting speed, cutting efficiency, output particulate matter size, material processing rate, maximum material input size, and others in some non-limiting examples. Such characteristics of the cutter disk 176 may include, but are not limited to, diameter or size, offset relative to the grind hub 158 and grind plate 190, position relative to a center of the grind plate 190 and the other cutter disks 176, and rotation or spin rate of each cutter disk 176. These characteristics and others of each cutter disk 176 may be the same or different in one or more embodiments.

The grind plate 190 also includes a plurality of baffles 202 (which may also be referred to herein as a plurality of ballasts 202). The baffles 202 are positioned around an outermost edge 204 of the grind plate 190 and are structured to convey the ground material from the grind hub 158 to the outlet described with reference to FIG. 5A and FIG. 5B. More specifically, the baffles 202 gather the particulate material and distribute it to the slide plate 168 (FIG. 5B) and the output conveyor 118 (FIG. 2A). The baffles 202 may have a curved or concave shape in order to more efficiently collect the particulate material, or the baffles 202 may be flat and planar. As shown in FIG. 7, the baffles 202 extend through the first surface 192 of the grind plate 190 in some embodiments, in order to improve the coupling between the baffles 202 and the grind plate 190 (i.e., the baffles 202 can be welded to the grind plate 190 on both sides) and to gather any material that passes the outermost edge 204 of the grind plate 190. Further, the baffles 202 extend beyond the outermost edge 204 of the grind plate 190 in order to allow more material to be output to the slide plate 168 (FIG. 5B). In some embodiments, the baffles 202 are arranged planar with the first surface 192 and may not extend past the outermost edge 204 of the grind plate 190.

FIG. 9 illustrates the drive hub 192 of the grind hub 158 in additional detail. The drive hub 192 includes a second side 205 with a second surface 206 that may also be a second side 205 and a second surface 206 of the grind hub 158. The system 100 includes a first axle 207 coupled to the grind hub 192 and a sheave 208 that may be cylindrical or tubular coupled to (or positioned on) the first axle 207 and structured to rotate about the first axle 207 via ball bearings. In other embodiments, alternatives to ball bearings may be implemented such as roller bearings, other types of bearings, or the like. A second axle 210 extends through a second bore in the drive hub 192 and is mechanically coupled to the cutter disk 176 (FIG. 7). A wheel 212 is coupled to the second axle 210 and a belt 214 is mechanically coupled between the sheave 208 and the wheel 212. The sheave 208 may also include ridges, splines, or another like structure, generally designated by 216. As described above, the sheave 208 rotates on the first axle 207 and in some embodiments, may be driven by hydraulic motors. Rotation of the sheave 208 drives the belt 214 and rotation of the belt 214 results in rotation of the wheel 212 and the second axle 210, and thus rotation of the cutter disk 176 (FIG. 7). The sheave 208 may rotate on the first axle 207 and be independently driven (such as by hydraulics, as above, or another drive source of the type described herein) to produce a selectable amount of rotation of the cutter disk 176 (i.e., a selectable cutting speed for the cutter disk 176).

The first axle 207, the sheave 208, the second axle 210, the wheel 212, and the belt 214 may be referred to herein as a drive assembly, a sheave and pulley assembly or a gear and belt assembly coupled to the second side 205 of the drive hub 192 and grind hub 158. Further, the first axle 207 is located centrally with respect to the drive hub 192 and the second axle 210 is spaced from the first axle 207 and located proximate an outer peripheral edge 218 of the drive hub 192 in some embodiments. Thus, rotation of the sheave 208 on the first axle 207 is about a central axis through the drive hub 192 along the first axle 207 while the rotation of second axle 210 is about an axis that is spaced from the center of the drive hub 192.

The drive hub 192 may further include one or more second holes 220, such as one, two, three, four, five, six, seven, eight or more second holes 220 with selected sizes or diameters and positions, in the second surface 206 to provide access to internal components of the drive hub 192 for repair and maintenance. The drive hub 192 may also include third holes 222 that align with first holes 194 in the grind plate 190 for coupling the grind plate 190 to the drive hub 192 to form the grind hub 158.

FIG. 9 also illustrates a drive assembly 224 for the drive hub 192. The drive assembly 224 includes a belt 226 wrapping around an outside diameter or an outer surface of the drive hub 192 that is driven by the motor 115 (FIG. 1). The motor 115 (FIG. 1) rotates the belt 226, which produces rotation of the drive hub 192. The drive assembly 224 also includes rollers or idlers 228 that increase tension in the belt 226 and increase the amount of surface area of the belt 226 in contact with the outer surface of the drive hub 192 relative to a system without rollers 228.

The cutter disk 176 (FIG. 7) is coupled to the drive hub 192 and the second axle 210 and the second axle 210 rotates independently of the drive hub 192 via the gear and pulley assembly. Thus, the cutter disk 176 rotates in place via the second axle 210 and also rotates around the drive hub 192 as the drive hub 192 rotates via the drive assembly 224. In other words, because of the arrangement of the axles 207, 210, the cutter disk 176 rotates about the center of the drive hub 192 in operation in order to more effectively grind material and to grind material in a wider area while also rotating independently of the drive hub 192 to increase the rotational speed of the cutter disk 176 (FIG. 7) to improve cutting efficiency. Further, a size of the sheave 208 and wheel 212 of the gear and pulley assembly can be selected to vary the speed at which the cutter disk 176 (FIG. 7) rotates about the second axle 210. Thus, the cutter disk 176 (FIG. 7) rotates via the second axle 210 and the drive hub 192.

Figure 10:
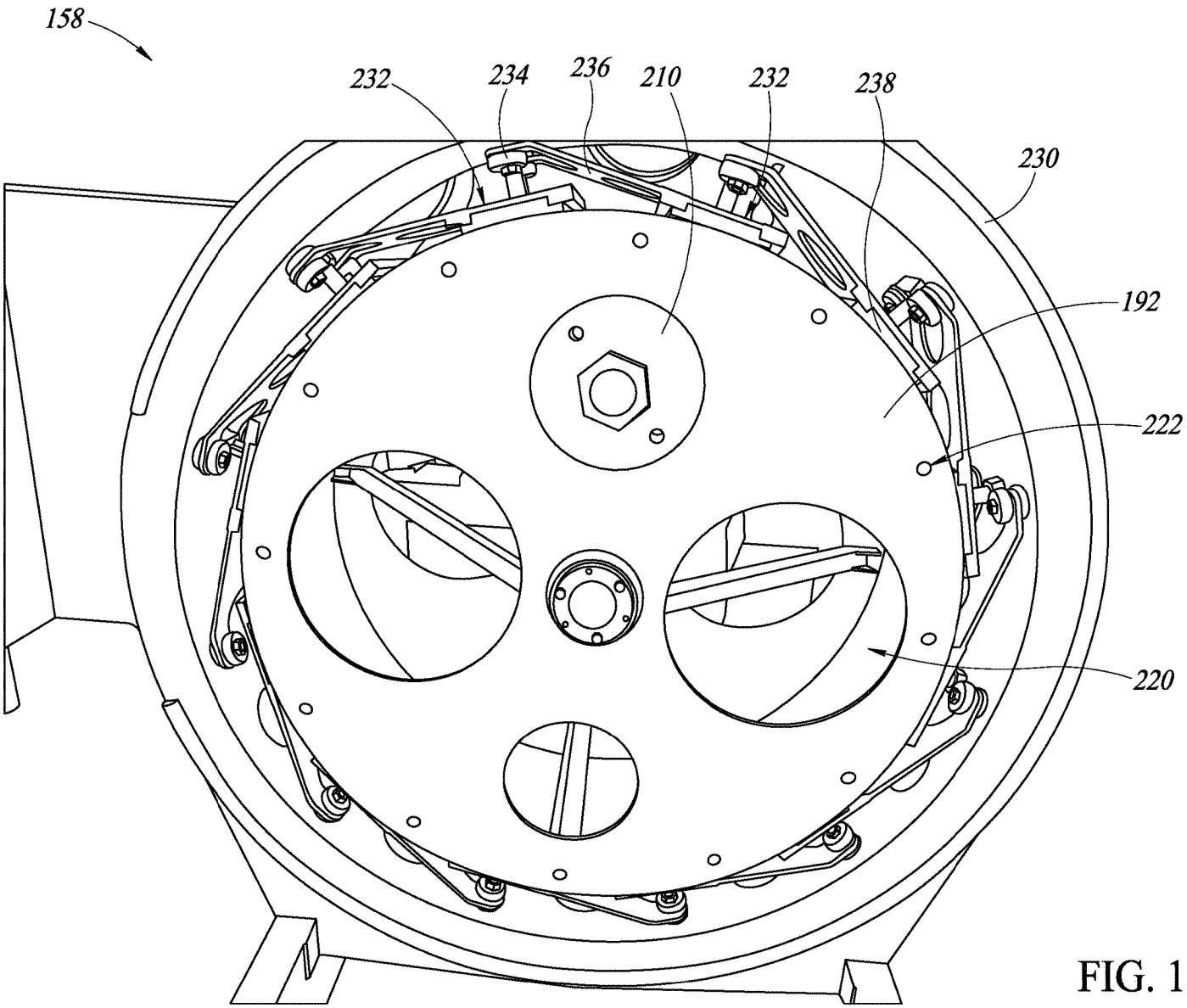
FIG. 10 is an elevational view of the first surface of the grind hub of the system of FIG. 8 illustrating adjustable segmented friction bearings coupled to the grind hub.

FIG. 10 is an elevational view of the grind hub 158 that illustrates additional details of the grind hub 158. The grind hub 158 is a combination of the drive hub 192 and a housing 230 that encases the drive hub 192. The system 100 further includes adjustable segmented friction bearings 232 (which may be referring to herein as bearings 232) coupled to the housing 230 and supporting the drive hub 192. The bearings 232 are bolted to the housing 320 and spaced around the outer diameter or outer surface of the drive hub 192. As illustrated in FIG. 10, there are twelve bearings 232 spaced equidistant about the drive hub 192, although the number and arrangement of bearings 232 may be selected to be different in one or more embodiments. For example, there may be more or less than twelve bearings 232 with a different spacing arrangement relative to the drive hub 192.

The bearings 232 are an assembly that includes an adjustable bolt and nut assembly 234 coupled to the housing 230 and an arm or plate 236 coupled to the adjustable bolt and nut assembly 234. The adjustable bolt and nut assemblies include the nuts shown in FIG. 10 and the bolts 235 shown in FIG. 1 extending from an outer surface of the housing 230. A bearing pad 238 is coupled to the arm 236 and is in direct contact with the outer surface of the drive hub 192. The bearing pad 238 is held in place against the drive hub 192 by tension from the arm 236. The tension in the arm 236 is adjustable by manipulating the bolt and nut assembly 234, and more specifically, by adjusting the bolts 235 shown in FIG. 1. The bolts 235 in the bolt and nut assemblies 234 extend through the housing 230 such that a head of the bolts is positioned on an outer surface of the housing 230. Thus, the bolts 235 of the assemblies 234 can be manipulated from outside of the housing 230 to more easily enable adjustment of the bearings 232. Further, the bearings 232 are removable via the bolt and nut assembly 234 for maintenance or replacement of the bearing pads 238.

The bearing pads 238 may be glass-filled Teflon in some embodiments, although other types of bearings or bearing pads such as rollers or ball bearings, among other like alternatives are expressly contemplated herein. As shown in FIG. 10, the arms 236 of the bearings 232 have a channel for receiving a correspondingly shaped protrusion on a rear side (i.e., a side facing away from the drive hub 192) of the bearing pads 238. The bearing pads 238 also include a front side (i.e., a side in contact with the drive hub 192) that extends beyond the channel in the arms 236 and provides a larger surface area for contact with the drive hub 192 relative to the protrusion of the pads 238 received in the channel in the arms 236. The drive assembly 224 described with reference to FIG. 9 is positioned behind the bearings 232 in the orientation shown in FIG. 10 with the bearings 232 supporting the drive hub 192 during rotation via the drive assembly 224.

Figure 11A:
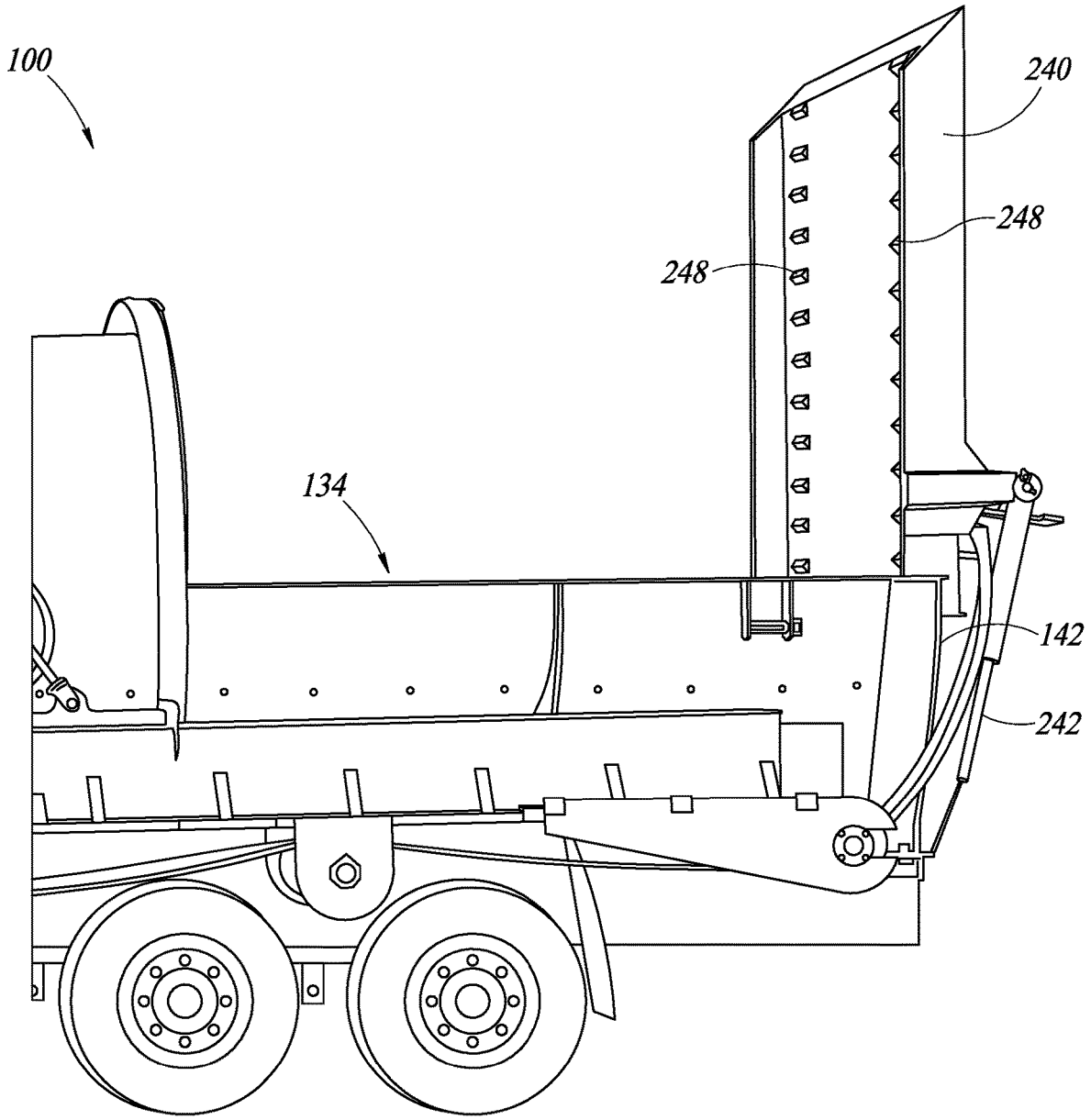
FIG. 11A is a partial elevational view of the system of FIG. 1 with a ramp in a first position.

FIG. 11A is a partial elevational view of the system 100 with a ramp 240 coupled to the tray 134. More specifically, the ramp 240 is coupled to the first end 142 of the tray 134, which may be a rear end in some embodiments. The ramp 240 is illustrated in FIG. 11A in a first position in which the ramp 240 is raised from the ground and positioned perpendicular to the tray 134. The first position may correspond to a storage or transportation position of the ramp 240. Further, the ramp 240 may be manipulated by actuators 242, which may be hydraulic linear actuators in some embodiments. In one or more embodiments, the actuators 242 are a different type of drive device, such as an electric actuator. The actuators 242 are coupled to user-manipulatable controls of the type described herein, such that the user can select a position of the ramp.

Figure 11B:
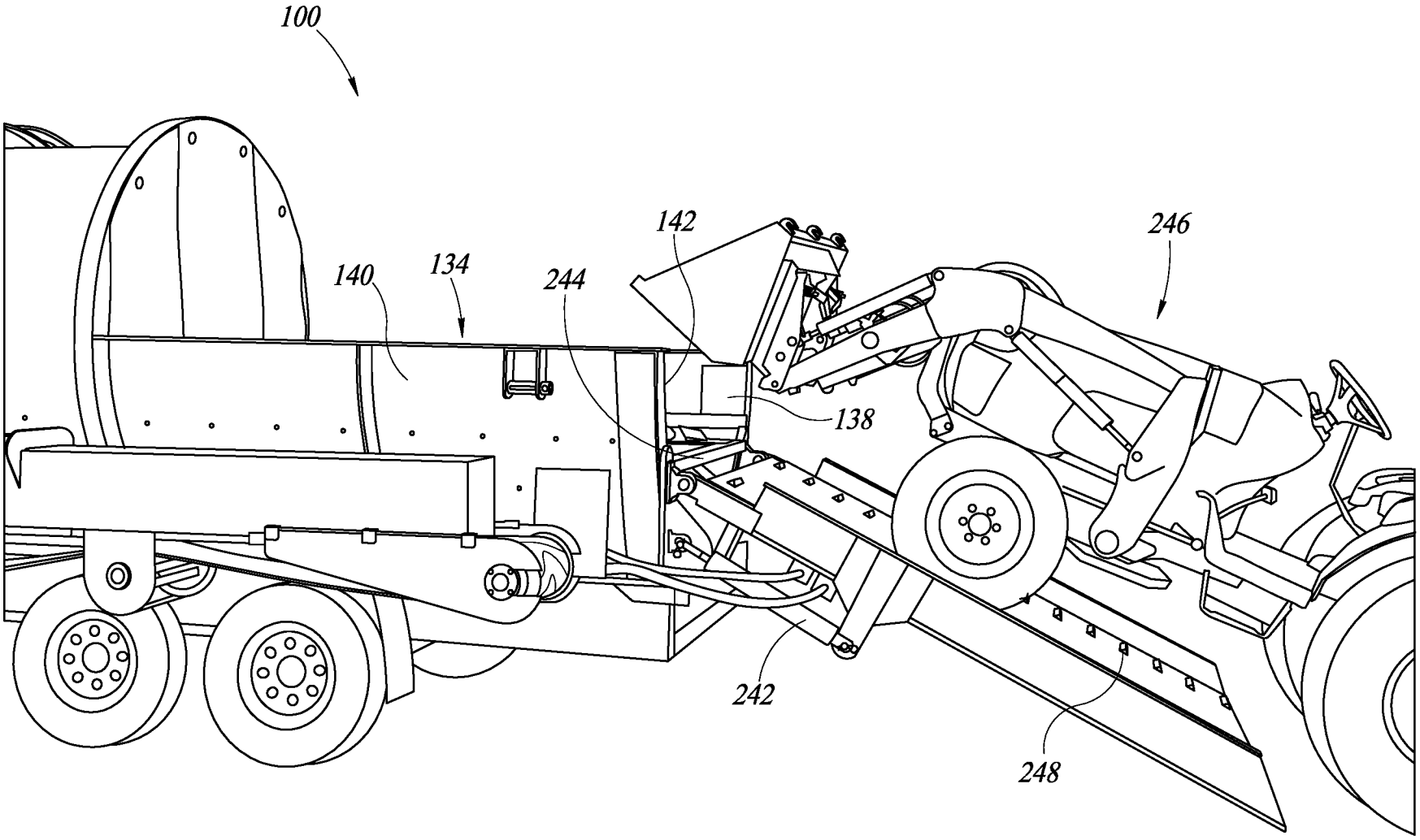
FIG. 11B is a partial perspective view of the system of FIG. 11B with the ramp in a second position.

FIG. 11B is a partial perspective view of the system 100 showing the ramp 240 in a second position. The second position may correspond to a loading position in which the ramp 240 is lowered to the ground via actuators 242. Thus, FIG. 11A and FIG. 11B demonstrate a full range of motion of the ramp 240 from the first position in FIG. 11A to the second position in FIG. 11B. It is to be appreciated that the ramp 240 can be selected to be positioned anywhere between the first and second positions via the user-manipulatable controls and the actuators 242.

In operation, and with reference to FIG. 11A and FIG. 11B, the ramp 240 is lowered from the first position shown in FIG. 11A to the second position shown in FIG. 11B. Then, a plate 244 is positioned in the tray 134. The plate 244 may be flat and planar and extends between the sidewalls 138, 140 (FIG. 4A) of the tray 134. The plate 244 may be coupled to the tray 134 or may be positioned to rest in the tray 134 without being physically coupled to the tray 134. A loader 246 can then be driven up the ramp 240 and parked on the plate 244 as in FIG. 11B. The ramp 240 may include protrusions 248 or other like traction devices on each side of the ramp 240 to prevent slippage of the loader 246 on the ramp 240.

Once the loader 246 is parked in the tray 134 on the plate 244, the ramp 240 is raised to the second position shown in FIG. 11A for transportation of the system 100 and the loader 246 to a jobsite or work location. The above process is repeated in reverse to drive the loader 246 off the plate 244 via the ramp 240 and remove the plate 244 from the tray 134. The ramp 240 may then be adjusted to be aligned with the tray 134 (i.e., at any selected position between the top and bottom of the sidewalls 138, 140 of the tray 134) to extend a length of the tray 134 and enable grinding of larger or longer bulk materials that would otherwise fall out of the tray 134. The loader 246 can be used at the job site to manipulate and load bulk material in the system 100, which eliminates the cost and logistical inefficiencies of renting or otherwise acquiring additional equipment to operate the system 100. Once the work is complete, the plate 244 is placed in the tray 134, the loader 246 is parked in the tray 134, and the ramp 240 is returned to the second position shown in FIG. 11A for transport to a different destination, as described above. Thus, the system 100 provides a complete, cost effective, and reliable solution to known issues with grinding bulk materials.

Certain words and phrases used in the specification are set forth as follows. As used throughout this document, including the claims, the singular form "a", "an", and "the" include plural references unless indicated otherwise. Any of the features and elements described herein may be singular, e.g., a sensor may refer to one sensor and a memory may refer to one memory. The terms "include" and "comprise," as well as derivatives thereof, mean inclusion without limitation. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Other definitions of certain words and phrases are provided throughout this disclosure.

Throughout the specification, claims, and drawings, the following terms take the meaning explicitly associated herein, unless the context clearly dictates otherwise. The term "herein" refers to the specification, claims, and drawings associated with the current application. The phrases "in one embodiment," "in another embodiment," "in various embodiments," "in some embodiments," "in other embodiments," and other variations thereof refer to one or more features, structures, functions, limitations, or characteristics of the present disclosure, and are not limited to the same or different embodiments unless the context clearly dictates otherwise. As used herein, the term "or" is an inclusive "or" operator, and is equivalent to the phrases "A or B, or both" or "A or B or C, or any combination thereof," and lists with additional elements are similarly treated. The term "based on" is not exclusive and allows for being based on additional features, functions, aspects, or limitations not described, unless the context clearly dictates otherwise. In addition, throughout the specification, the meaning of "a," "an," and "the" include singular and plural references.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the present disclosure.

Generally, unless otherwise indicated, the materials for making the invention and/or its components may be selected from appropriate materials such as metal, metallic alloys (high strength alloys, high hardness alloys), composite materials, ceramics, intermetallic compounds, and the like.

The foregoing description, for purposes of explanation, uses specific nomenclature and formula to provide a thorough understanding of the disclosed embodiments. It should be apparent to those of skill in the art that the specific details are not required in order to practice the invention. The embodiments have been chosen and described to best explain the principles of the disclosed embodiments and its practical application, thereby enabling others of skill in the art to utilize the disclosed embodiments, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the breadth and scope of a disclosed embodiment should not be limited by any of the above-described embodiments, but should be defined only in accordance with the following claims and their equivalents.

The invention claimed is:

1. A portable grinding machine, comprising:

a trailer;

a tray coupled to the trailer;

a grind hub coupled to the trailer and structured to rotate about a grind hub axis;

a grind ring coupled to the tray and structured to engage the grind hub during operation, the grind ring having an adjustable outlet;

a cutter disk coupled to the grind hub and structured to rotate about a cutter disk axis, the cutter disk axis being offset from the grind hub axis;

a plurality of plates coupled to the tray that slide along the tray back and forth towards the cutter disk and away from the cutter disk, wherein the plurality of plates includes a first row of plates coupled to a first track of the tray and a second row of plates coupled to a second track of the tray, the first row of plates on the first track and the second row of plates on the second track move independently from each other to oscillate relative to each other, where the first row of plates on the first track moves towards the cutter disk while the second row of plates on the second track moves away from the cutter disk, and where the first row of plates on the first track moves away from the cutter disk while the second row of plates moves on the second track towards the cutter disk; and a conveyor coupled to the grind hub having a first end and a second end, the first end of the conveyor positioned proximate the adjustable outlet of the grind ring, the conveyor including a belt that transports ground particulate matter away from the cutter disk and grind hub.

2. The portable grinding machine of claim 1 wherein the first row of plates pushes bulk materials towards the cutter disk while the second row of plates moves away from the cutter disk, and wherein the second row of plates pushes bulk materials towards the cutter disk while the first row of plates moves away from the cutter disk.

3. The portable grinding machine of claim 1 wherein the conveyor is rotatable relative to the trailer about the first end of the conveyer in a horizontal direction to move the second end of the conveyer towards a front end of the trailer or towards a rear end of the trailer, and wherein the conveyor is rotatable relative to the trailer about the first end of the conveyer in a vertical direction to change a position of the conveyer from parallel to a ground surface to perpendicular to the ground surface.

4. The portable grinding machine of claim 1 wherein the tray is a channel including a base and a first sidewall and a second sidewall extending from the base, the plurality of plates coupled to the base of the tray, the portable grinding machine further comprising:

a plurality of side feeders coupled to the first sidewall and the second sidewall of the tray.

5. The portable grinding machine of claim 4 wherein at least one of the plurality of plates and at least one of the plurality of side feeders include a plurality of teeth structured to ratchet a material received in the tray toward the grind hub and the cutter disk.

6. The portable grinding machine of claim 1 wherein the grind hub is structured to rotate in a first plane and the cutter disk is structured to rotate in a second plane that is at an offset angle from the first plane.

7. The portable grinding machine of claim 6 wherein the first plane is vertical and the second plane is at an offset angle to the first plane between 1 and 10 degrees.

8. The portable grinding machine of claim 1 further comprising:

a limit plate coupled to the grind hub and positioned between the grind hub and the grind ring.

9. The portable grinding machine of claim 1 wherein the grind ring further includes a plurality of teeth arranged around an interior circumference of the grind ring proximate the grind hub.

10. A grinding machine, comprising:

a grind hub structured to rotate about a grind hub axis;

a cutter disk coupled to the grind hub and structured to rotate about a cutter disk axis, the cutter disk axis being offset from the grind hub axis, wherein the cutter disk is structured to rotate about the cutter disk axis while also being structured to rotate about the grind hub axis;

a tray including a first row of plates coupled to a first track of the tray and a second row of plates coupled to a second track of the tray, the first row of plates on the first track and the second row of plates on the second track move independently from each other to oscillate relative to each other and towards the cutter disk and away from the cutter disk to advance bulk material towards the cutter disk; and a grind ring coupled to the tray, wherein the grind ring is structured to engage with the grind hub.

11. The grinding machine of claim 10 further comprising:

a frame coupled to the tray; and a plurality of wheels coupled to the frame.

12. The grinding machine of claim 10 wherein the grind hub has a first side and a second side opposite the first side, the grind hub further including:

a sheave and pulley assembly coupled to the first side of the grind hub;

a grind plate coupled to the second side of the grind hub;

a first limiter coupled to the grind plate;

a plurality of baffles coupled to the grind plate; and a second limiter coupled to the plurality of baffles.

13. The grinding machine of claim 12 wherein the sheave and pulley assembly includes an axle located proximate a center of the grind hub and a wheel coupled to the grind hub and spaced from the center of the grind hub, the sheave and pulley assembly further including a belt mechanically coupled to the axle and the wheel.

14. The grinding machine of claim 13 wherein the cutter disk is mechanically coupled to the wheel of the gear and pulley assembly with the cutter disk structured to rotate around the center of the grind hub.

15. The grinding machine of claim 10 wherein the grind ring further includes a plurality of teeth arranged around an interior circumference of the grind ring proximate the grind hub.

16. The grinding machine of claim 10 wherein the first row of plates pushes the bulk materials towards the cutter disk while the second row of plates moves away from the cutter disk, and wherein the second row of plates pushes bulk materials towards the cutter disk while the first row of plates moves away from the cutter disk.

17. The grinding machine of claim 10 further comprising:

a conveyor rotatably coupled to the grind hub, the conveyor including a belt that transports ground particulate matter away from the cutter disk and grind hub.

18. The grinding machine of claim 17 wherein the conveyor is rotatable relative to the grind hub about a first end of the conveyer in a horizontal direction to move a second end of the conveyer towards a front end of the grind hub or towards a rear end of the grind hub, and wherein the conveyor is rotatable relative to the grind hub about the first end of the conveyer in a vertical direction to change a position of the conveyer relative to a ground surface in the vertical direction.

19. The grinding machine of claim 10 wherein the tray is a channel including a base and a first sidewall and a second sidewall extending from the base, the first row of plates coupled to the base of the tray and the second row of plates coupled to the base of the tray, the grinding machine further comprising:

a plurality of side feeders coupled to the first sidewall and the second sidewall of the tray.

20. The grinding machine of claim 19 wherein at least one of the first row of plates and at least one of the plurality of side feeders include a plurality of teeth structured to ratchet the bulk material received in the tray toward the grind hub and the cutter disk.

21. The grinding machine of claim 10 wherein the grind hub is structured to rotate about the grind hub axis in a first plane that is vertical and cutter disk is structured to rotate about the cutter disk axis in a second plane at an offset angle to the first plane between 1 and 10 degrees.

22. A grinding machine, comprising:

a body having a grinding portion including a grind hub and a grind ring, the grind hub structured to rotate in a first plane about a grind hub axis, and an inlet portion including a tray coupled to the grind ring;

an advancement system coupled to the tray structured to advance bulk material towards the grinding portion;

a cutter disk coupled to the grinding portion of the body and structured to rotate about a cutter disk axis in a second plane at an offset angle to the first plane, wherein the cutter disk is structured to rotate about a cutter disk axis while also being structured to rotate about the grind hub axis; and a conveyor coupled to the body, the conveyor including a belt that transports ground particulate matter away from the cutter disk and grind hub.

23. The grinding machine of claim 22 further comprising:

a trailer including a frame coupled to the body and a plurality of wheels coupled to the frame.

24. The grinding machine of claim 22 wherein the grind ring is structured to slide to engage the grind hub, the grind ring having an outlet and the grind ring having a plate structured to selectively cover the outlet of the grind ring to vary a size of a particulate material output from the grind ring through the outlet.

25. The grinding machine of claim 22 wherein the grind hub includes a center and an outer peripheral edge, the grinding machine further comprising:

a first limiter coupled to the grind hub and positioned proximate the center of the grind hub; and a second limiter coupled to the grind hub and positioned proximate the outer peripheral edge of the grind hub.

26. The grinding machine of claim 22 wherein the grind hub includes an outer peripheral edge and a plurality of baffles positioned proximate the outer peripheral edge.

27. The grinding machine of claim 22 wherein the offset angle between the first plane and the second plane is between 1 and 10 degrees.

28. The grinding machine of claim 22 wherein the advancement system is one of: a plurality of plates, a belt conveyor, a chain conveyor, a ram plate, one or more augers, and one or more vibrators.

29. The grinding machine of claim 22 wherein the advancement system is a plurality of plates coupled to the tray including a first row of plates structured to push the bulk materials towards the cutter disk while a second row of plates moves away from the cutter disk and a second row of plates structured to push bulk materials towards the cutter disk while the first row of plates moves away from the cutter disk.

30. The grinding machine of claim 22 wherein the conveyor is rotatable relative to the body about a first end of the conveyer in a horizontal direction to move a second end of the conveyer towards a front end of the body or towards a rear end of the body, and wherein the conveyor is rotatable relative to the body about the first end of the conveyer in a vertical direction to change a position of the conveyer from parallel to a ground surface to perpendicular to the ground surface.

31. The grinding machine of claim 22 wherein the tray is a channel including a base and a first sidewall and a second sidewall extending from the base, and the advancement system includes a plurality of plates coupled to the base of the tray, the portable grinding machine further comprising:

a plurality of side feeders coupled to the first sidewall and the second sidewall of the tray.

32. The grinding machine of claim 31 wherein at least one of the plurality of plates and at least one of the plurality of side feeders include a plurality of teeth structured to ratchet a material received in the tray toward the grind hub and the cutter disk.

33. The grinding machine of claim 22 further comprising:

a limit plate coupled to the grind hub and positioned between the grind hub and the grind ring.

34. The grinding machine of claim 22 wherein the cutter disk is a first cutter disk, the grinding machine further comprising:

a second cutter disk coupled to the grinding portion of the body and structured to rotate.

35. A grinding machine, comprising:

a body having a grinding portion and an inlet portion, the grinding portion including a grind hub and a grind ring with the grind hub structured to rotate in a first plane, and the inlet portion including a tray coupled to the grind ring;

a cutter disk coupled to the grinding portion of the body and structured to rotate in a second plane at an offset angle to the first plane; and an advancement system coupled to the body structured to advance bulk material towards the grinding portion.

36. The grinding machine of claim 35 wherein the advancement system is one of: a plurality of plates, a belt conveyor, a chain conveyor, a ram plate, one or more augers, and one or more vibrators.

37. The grinding machine of claim 35 wherein the advancement system is a plurality of plates coupled to the tray including a first row of plates structured to push the bulk materials towards the cutter disk while a second row of plates moves away from the cutter disk and a second row of plates structured to push bulk materials towards the cutter disk while the first row of plates moves away from the cutter disk.

38. The grinding machine of claim 35 further comprising:

a trailer coupled to the body; and a conveyor coupled to the body, the conveyor including a belt that transports ground particulate matter away from the cutter disk and grind hub.

39. The grinding machine of claim 38 wherein the conveyor is rotatable relative to the trailer about a first end of the conveyer in a horizontal direction to move a second end of the conveyer towards a front end of the trailer or towards a rear end of the trailer, and wherein the conveyor is rotatable relative to the trailer about the first end of the conveyer in a vertical direction to change a position of the conveyer from parallel to a ground surface to perpendicular to the ground surface.

40. The grinding machine of claim 35 wherein the tray is a channel including a base and a first sidewall and a second sidewall extending from the base, and the advancement system includes a plurality of plates coupled to the base of the tray, the portable grinding machine further comprising:

a plurality of side feeders coupled to the first sidewall and the second sidewall of the tray.

41. The grinding machine of claim 35 wherein at least one of the plurality of plates and at least one of the plurality of side feeders include a plurality of teeth structured to ratchet a material received in the tray toward the grind hub and the cutter disk.

42. The grinding machine of claim 35 wherein the offset angle is between 1 and 10 degrees.

43. The grinding machine of claim 35 further comprising:

a limit plate coupled to the grind hub and positioned between the grind hub and the grind ring.

44. The grinding machine of claim 35 wherein the grind hub includes a drive hub with an outer surface, the grinding machine further comprising:

a drive assembly coupled to the body and including a motor and a belt on the outer surface of the drive hub, the motor structured to rotate the belt to rotate the drive hub.

45. The grinding machine of claim 35 wherein the cutter disk is a first cutter disk, the grinding machine further comprising:

a second cutter disk coupled to the grinding portion of the body and structured to rotate.

46. The grinding machine of claim 35 wherein the second cutter disk is structured to rotate in a third plane at an offset angle to at least one of the first plane and the second plane.

* * * * *